United States Patent [19]

Dinsdale

[11] Patent Number: 5,038,871

[45] Date of Patent: Aug. 13, 1991

[54] APPARATUS FOR SUPPORTING A DIRECT DRIVE DRILLING UNIT IN A POSITION OFFSET FROM THE CENTERLINE OF A WELL

[75] Inventor: Michael C. Dinsdale, Richardson, Tex.

[73] Assignee: National-Oilwell, Houston, Tex.

[21] Appl. No.: 538,634

[22] Filed: Jun. 13, 1990

[51] Int. Cl.[5] ..... E21B 19/00

[52] U.S. Cl. ..... 175/52; 175/85; 173/39; 173/42

[58] Field of Search ..... 175/52, 85, 161, 203; 173/28, 39, 42–44

[56] References Cited

U.S. PATENT DOCUMENTS

| | | | |
|---|---|---|---|
| 2,792,198 | 3/1957 | Braun | 255/19 |
| 3,143,220 | 9/1964 | Goepfert | 214/2.5 |
| 3,340,938 | 8/1967 | Wilson | 173/28 |
| 3,451,493 | 3/1969 | Storm | 175/9 |
| 3,495,667 | 2/1970 | Cales | 175/161 |
| 3,708,024 | 1/1973 | Back | 175/52 |
| 3,835,940 | 9/1974 | Winter, Jr. | 175/52 |
| 4,262,754 | 4/1981 | Nelson | 173/43 |
| 4,421,179 | 12/1983 | Boyadjieff | 175/85 |
| 4,437,524 | 2/1984 | Boyadjieff et al. | 173/43 |
| 4,458,768 | 3/1984 | Boyadjieff | 175/85 |
| 4,610,315 | 9/1986 | Koga et al. | 175/52 |
| 4,843,945 | 7/1989 | Dinsdale | 175/85 |

*Primary Examiner*—Bruce M. Kisliuk

*Attorney, Agent, or Firm*—R. J. Bunyard; L. A. Fillnow; R. H. Johnson

[57] ABSTRACT

Drilling equipment including apparatus for laterally moving a direct drive drilling unit to a position offset from the centerline of a well. The drilling equipment includes a traveling block suspended for generally vertical travel within a derrick during drilling of a well, a direct drive drilling unit suspendable from the traveling block, means for guiding the drilling unit during drilling and apparatus connected to the derrick for moving the drilling unit laterally relative to the axis of the well to an offset position. The drilling unit includes a drill motor and a drive sleeve for threadably connecting the drill motor to a drill string in the well. The guide means includes a first pair of rails connected to the derrick and extending parallel to the axis of the well. The apparatus includes a second pair of rails and means for supporting the drilling unit. The second pair of rails is positionable below and in alignment with the first pair of rails when the support means is in the offset position.

29 Claims, 20 Drawing Sheets

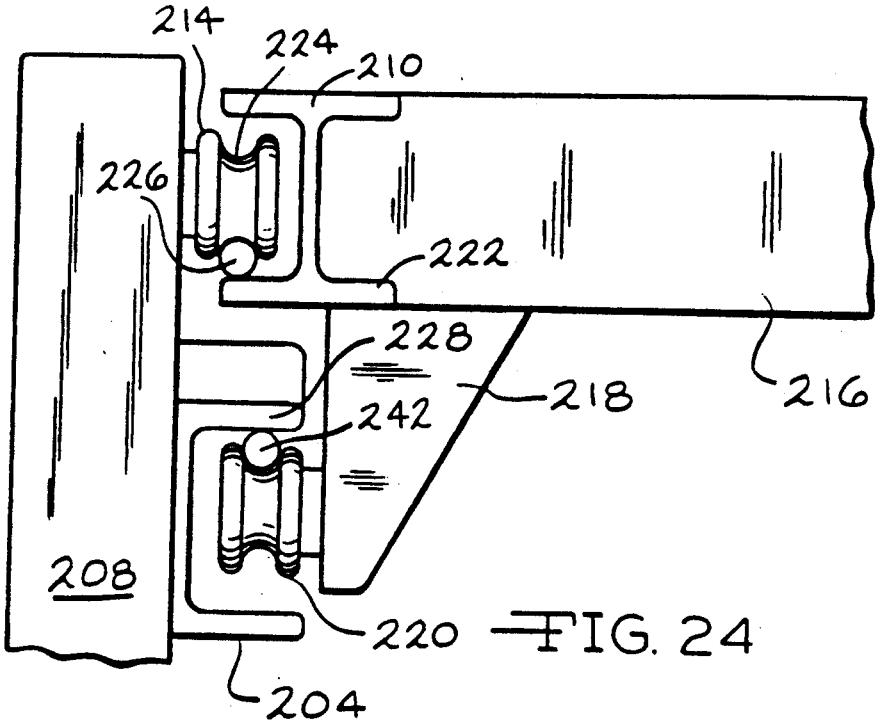
FIG. 24
FIG. 25
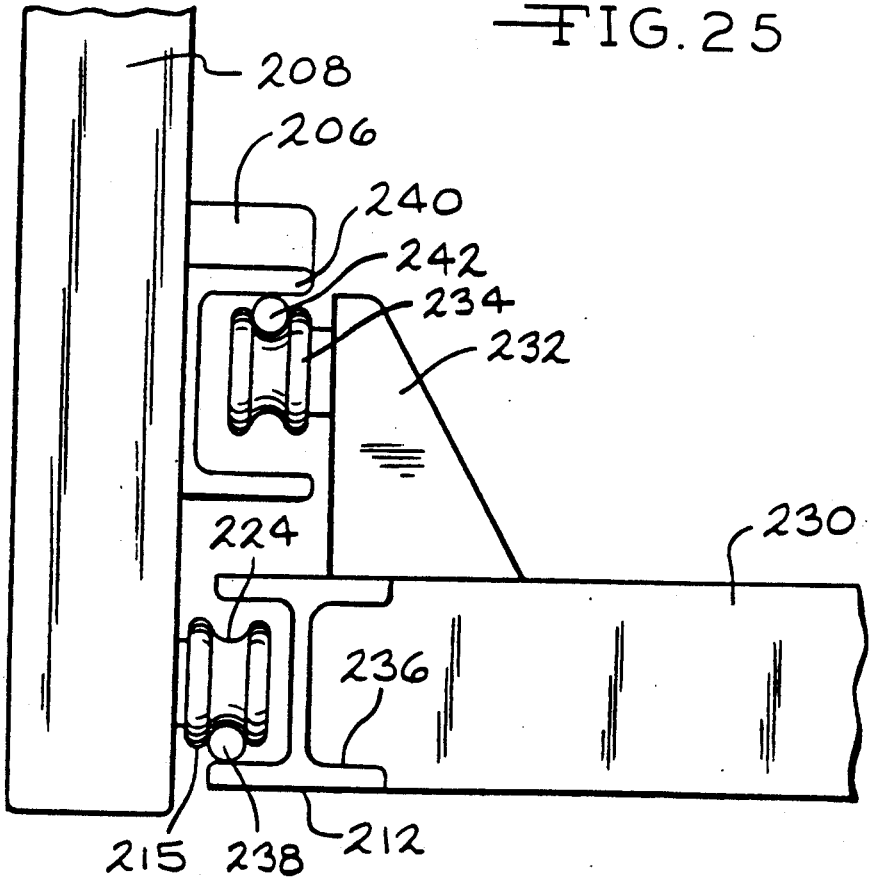

APPARATUS FOR SUPPORTING A DIRECT DRIVE DRILLING UNIT IN A POSITION OFFSET FROM THE CENTERLINE OF A WELL

BACKGROUND OF THE INVENTION

This invention relates to well drilling equipment including a direct drive drilling unit. More particularly, the invention relates to apparatus and a method for moving the drilling unit from a well centerline position to a position laterally offset from the centerline of the well during tripping, when performing maintenance or when lining the well with casing.

Conventional rotary drilling includes a rotary table, a motor mounted on or below the derrick floor for rotating the table, and a kelly for rotationally connecting the table to a drill string. In recent years, these drilling units are being replaced by or retrofitted with direct drive drilling units. A direct drive drilling unit is suspended from a traveling block for vertical travel within a standard derrick or mast, hereafter referred to as a derrick. The drilling unit is mounted on a carriage connected to a pair of vertical guide rails secured to the derrick.

A direct drive type drilling unit includes a motor drive assembly and a pipe handling assembly. The drive assembly includes a drill motor connected to the drill string by a cylindrical drive sleeve or sub assembly extending downwardly along the centerline of the well from the drill motor. Drilling is accomplished by the powered rotation of the drill string by the drill motor.

A cutting tool or bit is threadably connected the bottom of the drill string which, through the rotational energy supplied by the drill motor, cuts through the earth formation and deepens the well. As the well is drilled, the bit becomes worn and periodically must be replaced. When replacement of the bit becomes necessary, a portion of the drill string corresponding in length to one or more sections of drill pipe is removed from the well and pulled above the derrick floor. This portion of the drill string is removed to a pipe storage rack on the derrick. The drill string again is pulled from the well exposing the next pipe section above the floor which is similarly removed. This sequence, usually referred to as tripping out, is continued until the entire drill string is removed from the well. The bit on the bottom of the drill string is replaced and the drill string is then reassembled; i.e. tripping in, by connecting all the pipe sections previously removed.

Sometimes it is undesirable to use the drilling unit to remove or add the pipe sections to the drill string during the tripping sequence. It also may be undesirable to support a long length of casing from the drilling unit when running casing liner into a well since supporting the entire weight of the drill string or well casing using the drilling unit handling assembly may cause additional wear of the drilling unit. It may be desirable to remove the drilling unit from the traveling block and use conventional hoisting equipment for supporting the drill string or the well casing. The connection between the lower end of the drive sleeve and the upper end of the drill string is broken, the drilling unit is disconnected from the traveling block, and then the drilling unit is laterally displaced away from the centerline of the well. Conventional hoisting equipment is attached to the traveling block for directly supporting the drill string or well casing during the tripping sequence or when lining the well with casing.

It is known to provide for lateral movement of a direct drive drilling unit between a drilling position and a position offset away from the axis of the well. U.S. Pat. No. 4,458,768 discloses a direct drive type drilling unit suspended for vertical travel within a derrick. The drilling unit is mounted on a carriage connected to a pair of guide rails. The guide rails extend parallel to the well axis and include an upper portion and a lower portion. The lower portion of the rails extends downwardly to near the floor of the derrick. One of the rails of the lower portion is pivotally mounted for swinging the drilling unit from the drilling position to a position offset away from the axis of the well. U.S. Pat. No. 4,437,524 discloses a similar arrangement for lateral movement of the drilling unit. The rails again include an upper portion and a lower portion. Both of the rails of the lower portion are rigidly connected to horizontal and diagonal elements forming an integral framework with the entire framework being mounted to the derrick for swinging movment about the well axis. When moved to the offset position, the drilling unit is replaced with conventional hoisting equipment that is attached to the traveling block. The traveling block is mounted on a carriage connected to the rails. During drilling of the well, the drilling unit can travel the full length of the derrick utilizing both the upper and lower portions of the rails. During tripping with the drilling unit in the offset position; however, travel by the traveling block carriage is restricted to only the upper portion of the rails. Travel by the carriage along the lower portion of the rails is prevented because one or both of the rails of the lower portion supports the drilling unit in the offset position with travel by the carriage being blocked along that portion of the lower rails supporting the drilling unit. When one or both of the lower rails are used to support the drilling unit in the offset position, it is difficult to use conventional hoisting equipment during tripping or when lining a well. When maintenace is required on the drilling unit, it also is difficult to continue drilling using conventional rotary drilling equipment with the drilling unit in the offset position. Temporarily storing the drilling unit in an offset position so close to the derrick floor allows the mud and service lines to be suspended close to the work area. This creates an unsafe environment because it adds to the clutter on the derrick floor for the drilling operators with the mud and service lines being subject to possible damage. Locating the pivot point near one of the rails of the lower portion causes the mud and service lines to become twisted 90°–180° when rotating the drilling unit to the offset position causing possible damage to the lines.

Accordingly, there remains a need for an apparatus for moving a suspended direct drive type drilling unit to a position offset from the well axis so that suspended hoisting equipment can freely travel the full length of the derrick or permit conventional rotary drilling equipment temporarily be used. There also remains a need for an apparatus that allows the drilling unit to be positioned in the offset position without restricting drilling operator movement under or around the drilling unit while in the offset position or causing damage to the mud and service lines. There remains a further need for an apparatus that conveniently allows a direct drive drilling unit to be installed in or removed from the derrick.

BRIEF SUMMARY OF THE INVENTION

The invention relates to a direct drive drilling unit suspended for generally vertical travel within a derrick and includes a pair of upper rails connected to the derrick and extending parallel to the axis of a well for guiding the drilling unit during drilling of the well, a drive sleeve for threadably connecting a drill motor to the upper end of a drill string in the well, and apparatus for laterally moving the drilling unit from the drilling position to a position offset from the axis of the well. The apparatus is connected to the derrick and includes a pair of lower rails for positioning below and in alignment with the upper rails and means for supporting the drilling unit in the offset position.

It is a principal object of the invention to provide apparatus for laterally moving a suspended drilling unit to a position offset from the well axis without restricting floor space when it is unnecessary to use the drilling unit.

Another object of the invention is to provide support means detachably connected to the apparatus to permit the drilling unit to be installed in or removed from the derrick.

Another object of the invention is to provide apparatus that allows conventional pipe handling equipment to travel the full length of the derrick when the drilling unit is in the offset position.

Another object of the invention is to provide apparatus that relocates, with minimal twisting, mud and service lines a safe distance above the work area when the drilling unit is the offset position.

A feature of the invention is a direct drive drilling unit suspended for generally vertical travel within a derrick, the drilling unit including a drill motor for rotation of a drill string into a well, means for guiding the drilling unit during travel when drilling the well, the guide means including a first pair of upper rails connected to the derrick and extending parallel to the axis of the well, and apparatus connected to the derrick for moving the drilling unit laterally from the drilling position to a position offset from the axis of the well, the apparatus including a second pair of lower rails and means for supporting the drilling unit in the offset position. The lower pair of rails and the support means are separately positionable below and in alignment with the fixed upper pair of rails. When the lower pair of rails is in alignment with the upper pair of rails and the support means is in the offset position, suspended pipe handling or drilling equipment can travel the full length of the upper and lower rails.

Another feature of the invention is for the apparatus to be slidably connected to the derrick.

Another feature of the invention is for the apparatus to be rotatably connected to the derrick.

Another feature of the invention is for the support means to include a pair of spaced skids for supporting the drilling unit in the offset position.

Another feature of the invention is for the apparatus to include lower rails connected to a frame which is connected to the derrick and the support means being detachably connected to the frame whereby the drilling unit can be installed in or removed from the derrick.

Another feature of the invention is for the frame to be supported by a track.

Another feature of the invention is for the support means to include a support carriage and a frame, the frame being detachably connected to the carriage and the carriage being supported by a track.

Advantages of the invention include quick and easy movement of the suspended drilling unit from the drilling position to the offset position and vice versa, removal of the suspended drilling unit to the offset position prior to a tripping operation or lining a well with casing, facilitate service and repair of the drilling unit while in the offset position, faster tripping times, elimination of wear to the drilling unit and service loop during tripping, reduction of equipment weight during tripping, minimizing risk to the well in the event of failure to the suspended drilling unit by being able to reestablish drilling and recirculation of drilling fluid in the drill string using conventional drilling equipment, minimizing power and fuel usage, and increasing the life of the drawworks cable and hoisting equipment.

The above and other objects, features and advantages of the invention will become apparent upon consideration of the detailed description and appended drawings.

BRIEF DESCRIPTION OF THE DRAWINGS

FIG. 24 is an elevation view taken along line 24—24 of FIG. 22, FIG. 25 is an elevation view taken along line 25—25 of FIG. 22.

DETAILED DESCRIPTION OF THE PREFERRED EMBODIMENT

Figure 1:
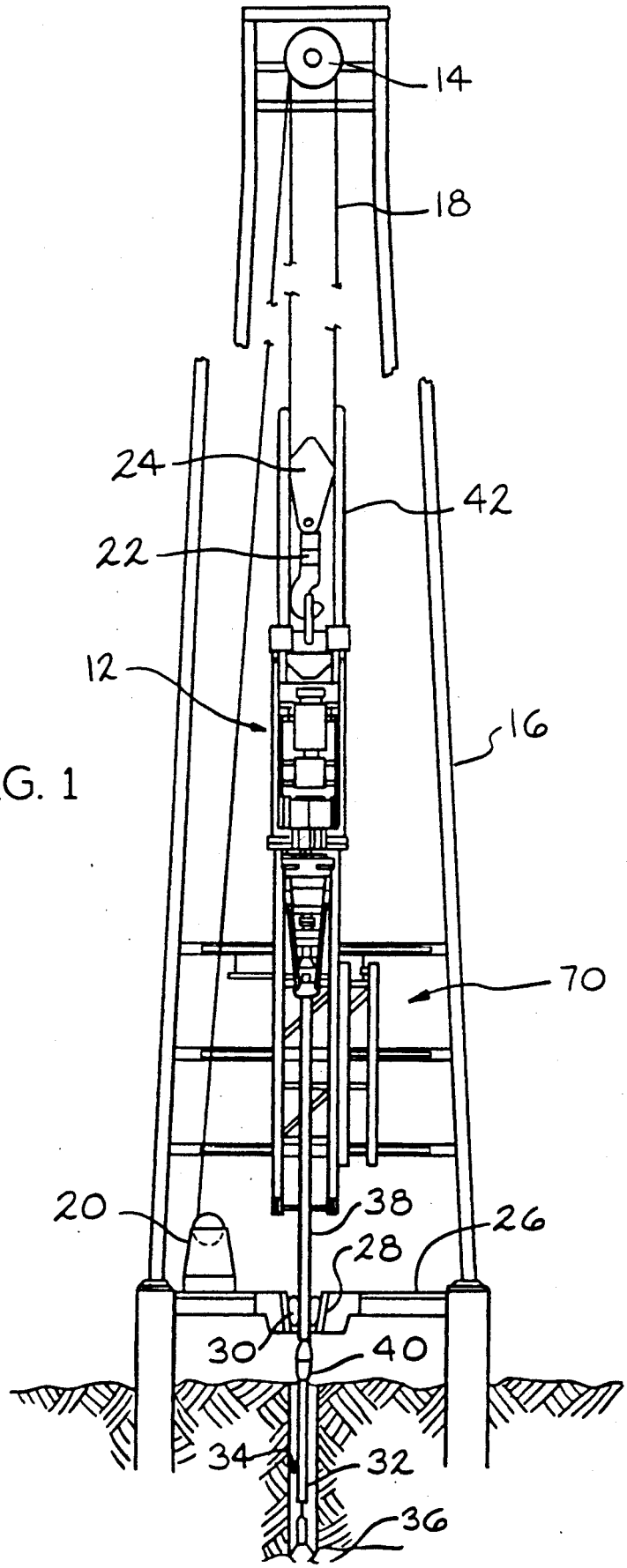
FIG. 1 is an elevation view of a suspended direct drive drilling unit incorporating the invention.

Referring to FIG. 1, reference numeral 12 denotes a direct drive drilling unit, hereafter referred to as a power swivel. Power swivel 12 is suspended from a crown block 14 within a derrick 16 by a rope 18. Rope 18 is reeved over block 14, a traveling block 24 and around a drawworks 20. Power swivel 12 is supported by a hook 22 connected to traveling block 24. Traveling block 24 may be mounted on a guide carriage 25 (see FIG. 13). Derrick 16 includes a floor 26, a slip bowl 28 and slips 30. A drill string 32 is rotated into a well 34 by the cutting action of a drill bit 36 threadably connected to the bottom of drill string 32. Drill string 32 is connected to power swivel 12 through one or more sections of drill pipe 38 via a tool joint 40. Power swivel 12 (see FIG. 13) includes a motor assembly 44 and a pipe handling assembly 46. More assembly 44 includes a drill motor 48 threadably connected to pipe 38 through a gear 50 by a drive shaft or sleeve 52 (also see FIG. 21). Handling assembly 46 includes a housing beam 54 for supporting a rotatable handling ring 56 which supports the load on an elevator 58 through a pair of elevator links 60 connected to handling ring 56. Power swivel 12 is suspended for travel by hook 22 through a bail 62 connected to a counterbalance 64. Loads on elevator 58 are supported by counterbalance 64 without passing through the swivel bearing located in housing beam 54 by being supported by a pair of swivel links 65 connecting housing beam 54 to counterbalance 64. Carriages 66 are mounted to motor assembly 44 and coupled to spaced elongated guide rails by rollers 68. The guide rails are rigidly connected to derrick 16 by bolting or welding. U.S. Pat. Nos. 4,809,792; 4,813,498 and 4,877,093; incorporated herein by reference, disclose additional details of power swivel 12. Power swivel 12 is remotely operated from a console (not shown) on floor 26 for simultaneous powered rotation of drill string 32 and guided for generally vertical travel within derrick 16 along a first pair of upper guide rails 42 rigidly connected to derrick 16 and extending parallel to the axis of well 34.

Figure 2:
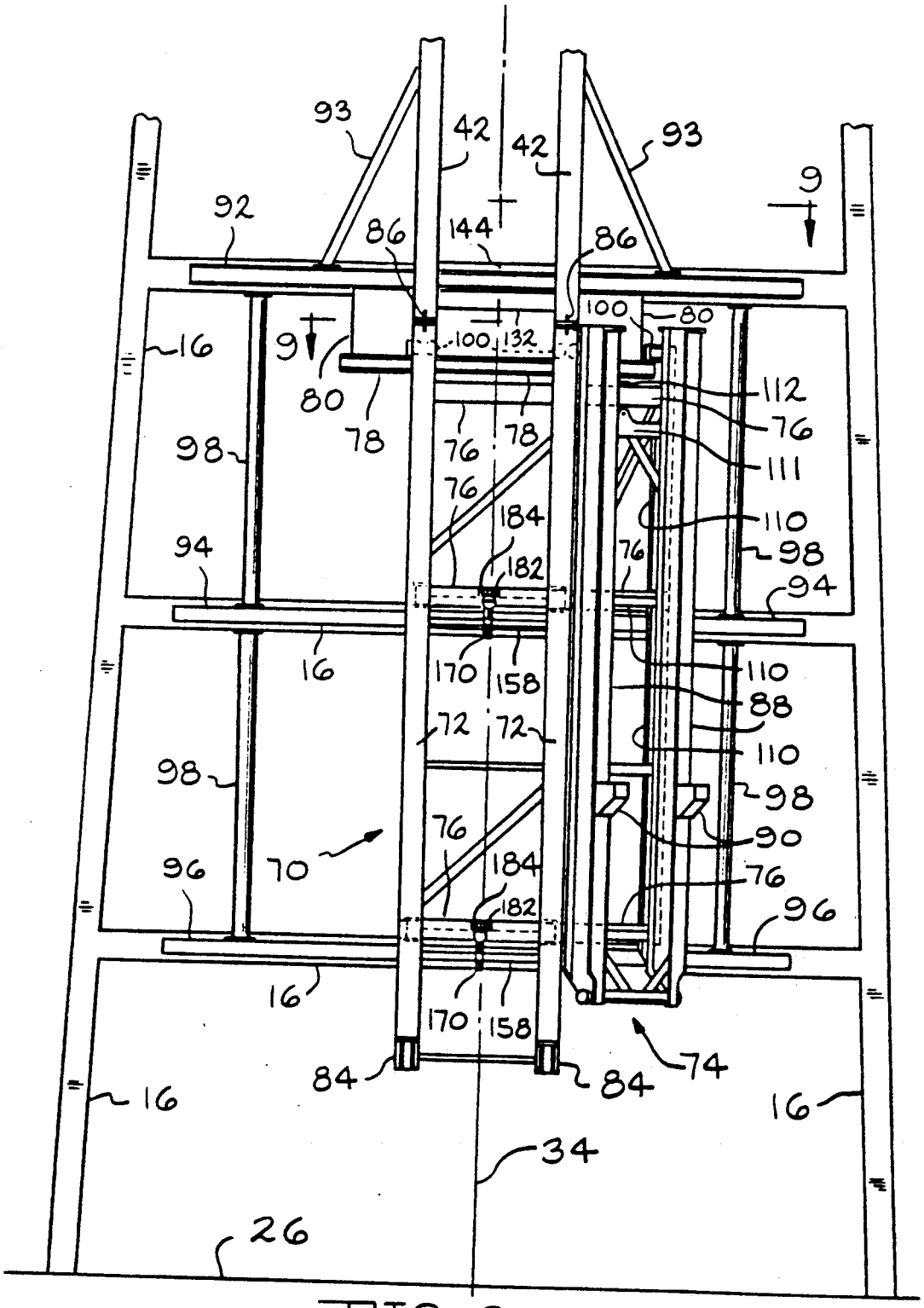
FIG. 2 is an elevation view of the apparatus in FIG. 1 for laterally moving the drilling unit with the lower rails in the drilling position.
Figure 3:
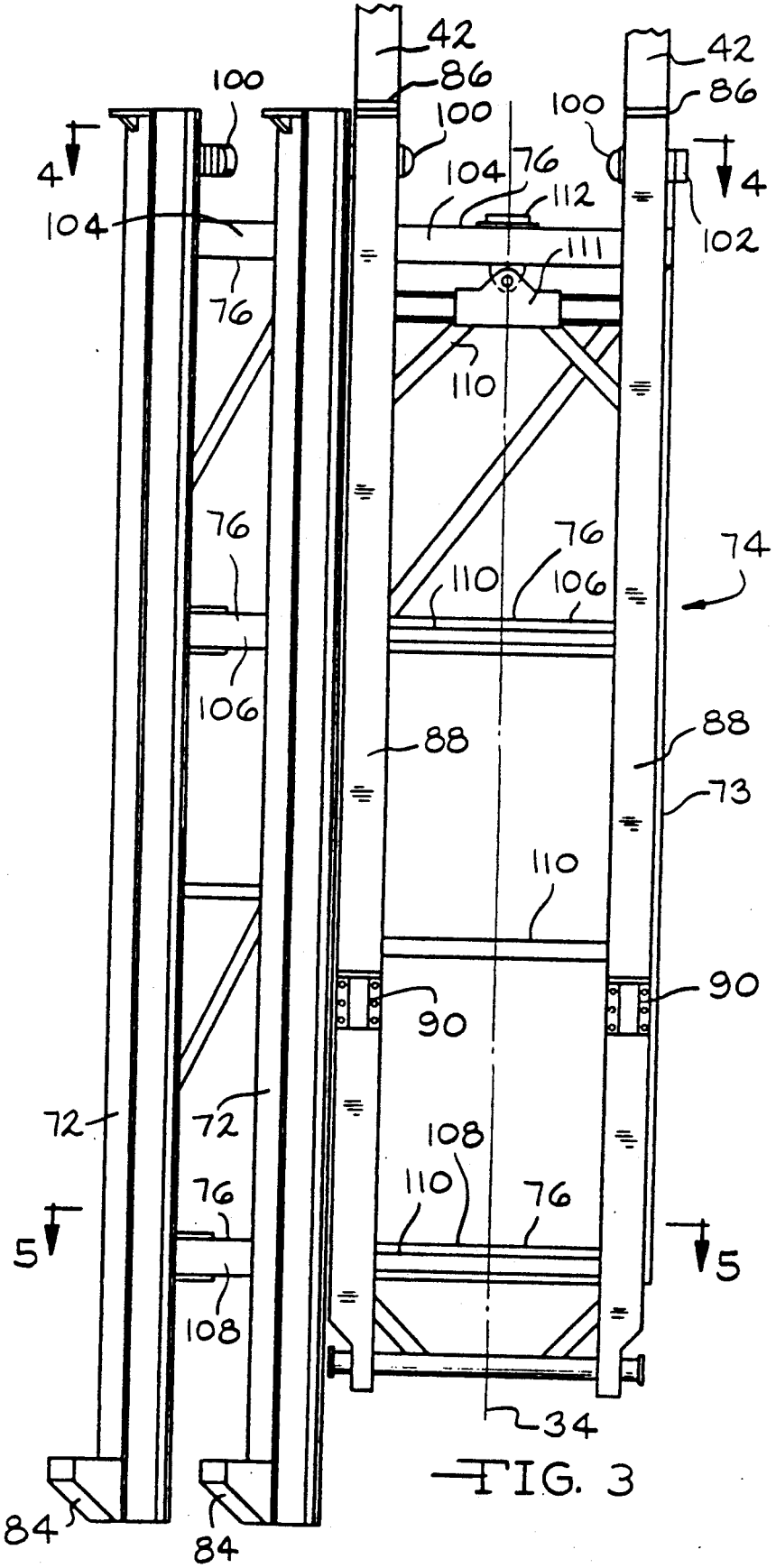
FIG. 3 is an elevation view of the apparatus of FIG. 2 illustrating the support means aligned with the upper pair of rails.
Figure 10:
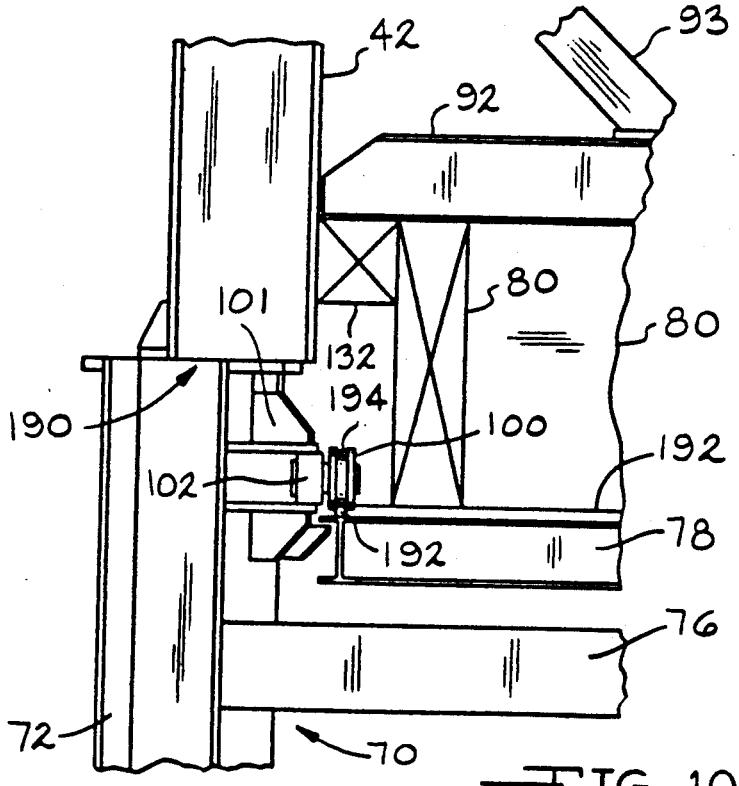
FIG. 10 is an enlarged elevation view showing details of the apparatus in FIG. 2 during rotation of the frame along the curved support track.
Figure 13:
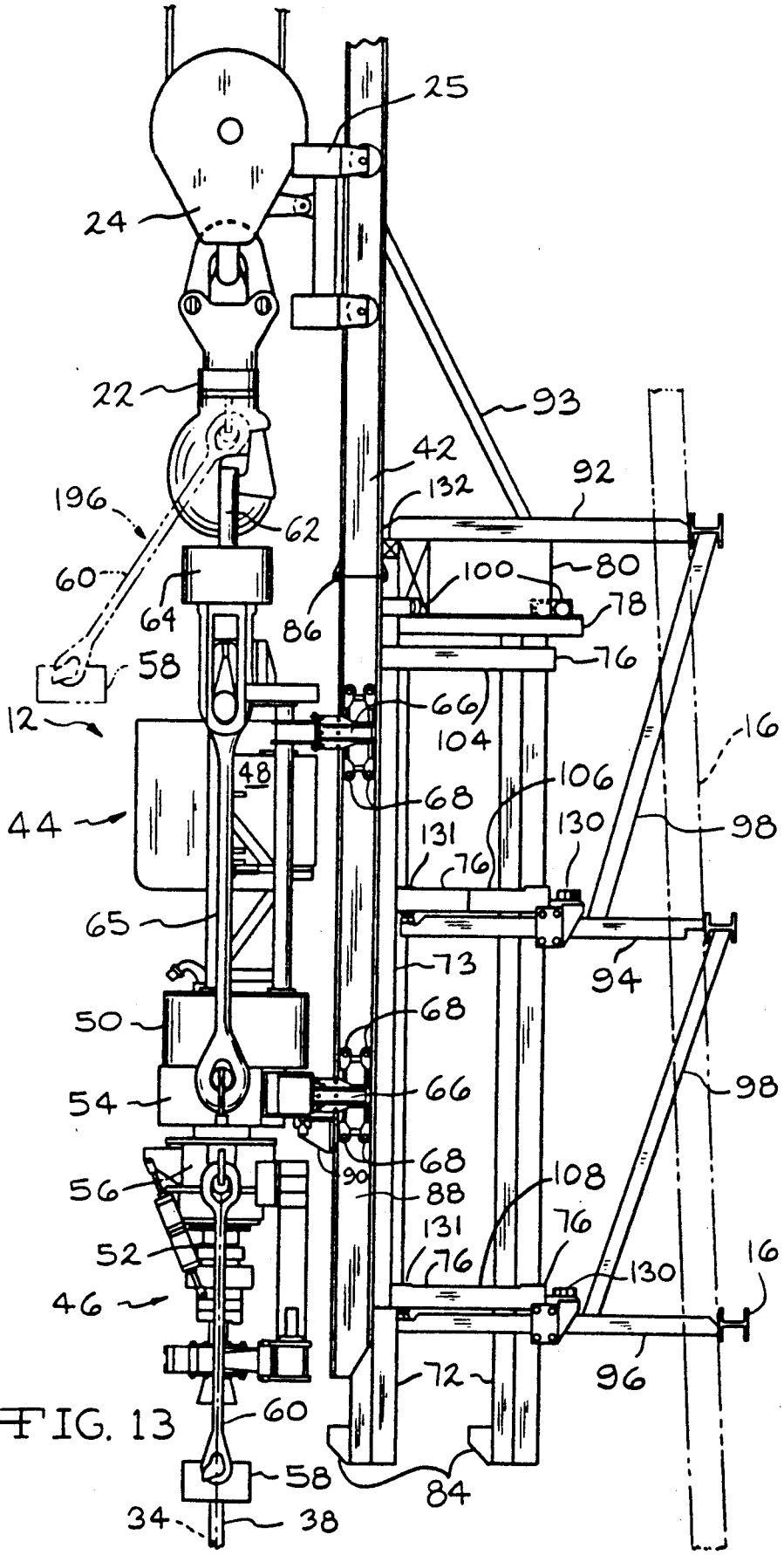
FIG. 13 is a side elevation view along line 13—13 of FIG. 14 illustrating the drilling unit about to be disengaged from a hook.
Figure 14:
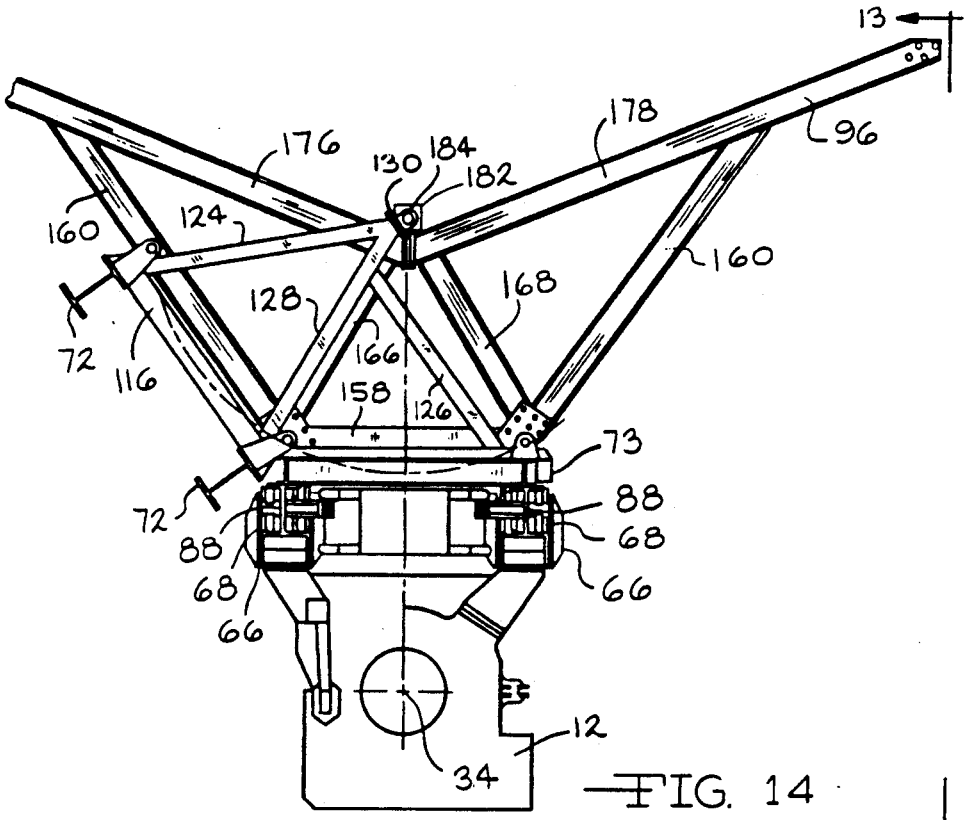
FIG. 14 is a plan view illustrating the apparatus position shown in FIG. 12 with the drilling unit having been lowered until supported by the stops of the skids.
Figure 15:
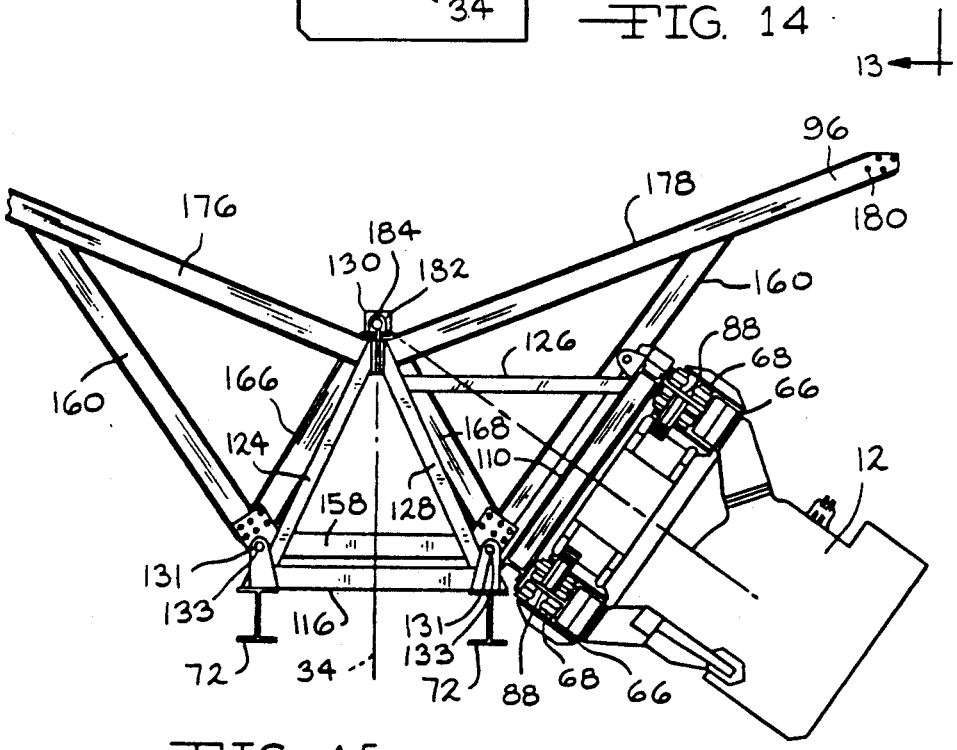
FIG. 15 is a plan view illustrating the apparatus position shown in FIG. 11 with the drilling unit having been disconnected from the hook and rotated counterclockwise to an offset position and with the lower pair of rails in the drilling position.

FIG. 2 shows in detail an apparatus 70 rotatably connected to derrick 16 for laterally moving power swivel 12 relative to well axis 34. Apparatus 70 includes a second pair of spaced lower rails 72 and means 74 for supporting power swivel 12 in a position laterally offset from well axis 34. Lower rails 72 and support means 74 of the invention separately are positionable below and in alignment with fixed upper rails 42. In FIG. 2, lower rails 72 are positioned below and in alignment with upper rails 42 in the drilling position and support means 74 is positioned in an inactive or offset position. Rails 72 and support means 74 are rigidly connected by bolting or welding to a frame 76 rotatably connected to derrick 16 and supported by a curved track 78. The upper surface of track 78 is welded to the lower surface of a hanger 80. The upper surface of hanger 80 is welded to the lower surface of a horizontal brace 92. Brace 92 is connected to upper rails 42 by support beams 93. Each lower rail 72 includes a stop 84 and is aligned with upper rail 42 by a splice 86. Stops 84 prevent rollers 68 of lower carriages 66 from disengaging rails 72 and support the weight of power swivel 12 when disconnected from hook 22. Support means 74 preferably includes a pair of spaced skids 88 each of which includes an adjustable stop 90 whose elevation above derrick floor 26 can be varied, e.g., a low elevation when maintenance to power swivel 12 is required or a higher elevation when it is necessary to keep the work area clear for the safety of the drilling operators. When in the offset position, power swivel 12 needs to be elevated sufficiently above derrick floor 26 so that the mud and service lines are suspended out of the work area to prevent possible damage to them and to reduce their interference with ongoing work. Frame 76 is pinned to each of horizontal braces 94, 96 which are bolted to derrick 16. Rails 72 and a vertical beam 73 are rotatably supported by curved track 78 by rollers 100 journaled on trunnions 102 as seen in FIGS. 3, 10 and 13. Additional support for apparatus 70 is provided by support beams 98 connecting braces 94, 96 to derrick 16. Skids 88 should have a length no greater than that of lower rails 72 so that the drilling operators can safely walk beneath. Skids 88 are spaced apart by the same distance as that of rails 42, 72. Since they are not intended for supporting the power swivel during drilling, skids 88 do not need to extend to near the derrick floor and do not need the structural strength to resist drilling torque as is the case for upper rails 42 and lower rails 72.

FIG. 3 illustrates an elevation view of frame 76 of apparatus 70 with skids 88 aligned with the upper pair of rails 42. Horizontal braces 92, 94, 96, curved track 78 and hanger 80 have been removed for clarity to better illustrate rotating frame 76. Rotating frame 76 includes an upper section 104, a mid section 106, and a lower section 108. The bottom flange of each of skids 88 of support means 74 is welded to means 110 which preferably is detachably connected to rotating frame 76 allowing power swivel 12 to be removed from or installed in derrick 16. Detachable means 110 is pinned to section 104 at clevis 112 by a bracket 111 and is bolted to each of sections 106, 108.

Figure 4:
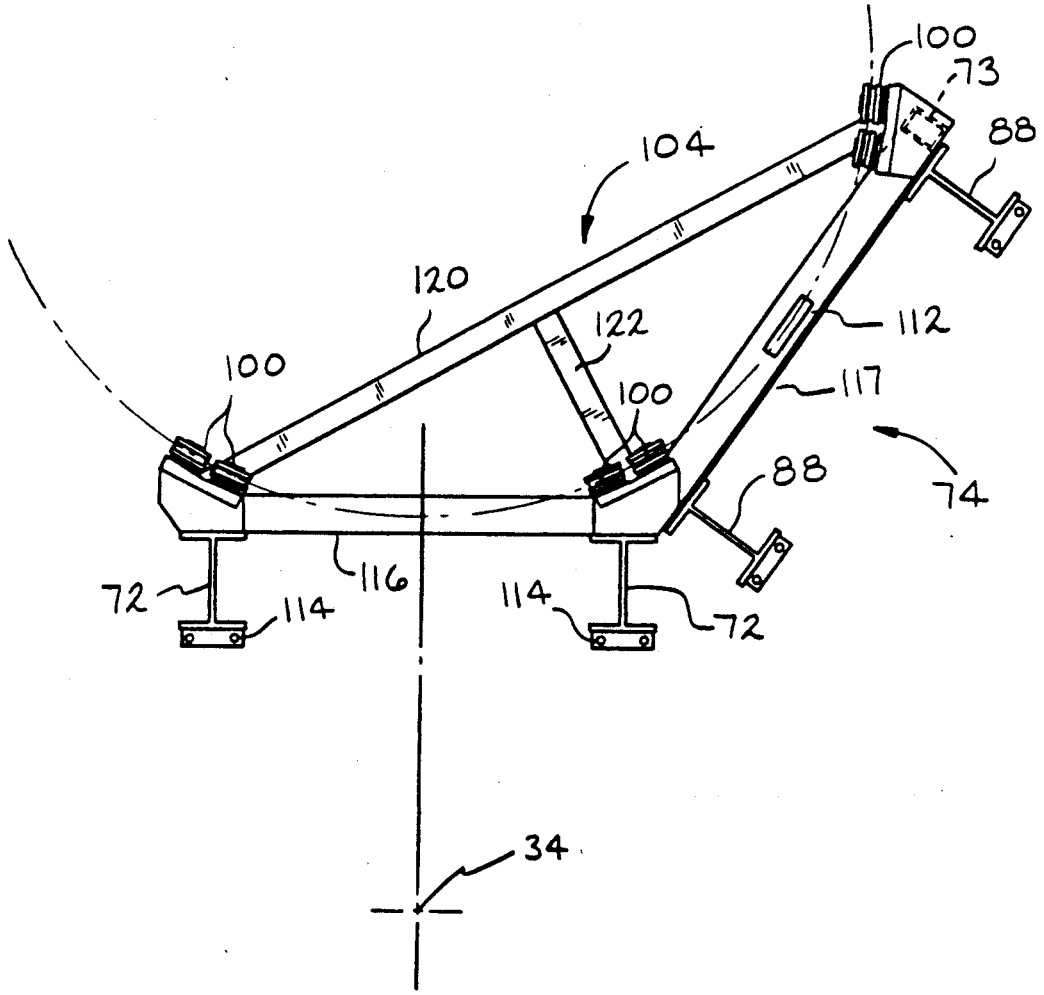
FIG. 4 is a plan view of the upper section of the apparatus frame taken along line 4—4 in FIG. 3.

FIG. 4 shows a plan view of upper section 104 with lower rails 72 in the drilling position. Lower rails 72 are welded to a base member 116 and skids 88 are welded to detachable means 110 (FIG. 5) which is pinned to a base member 117. Opposing ends of base members 116 and 117 are connected by a member 120. The adjacent ends of base members 116 and 117 are connected to member 120 by a member 122.

Figure 5:
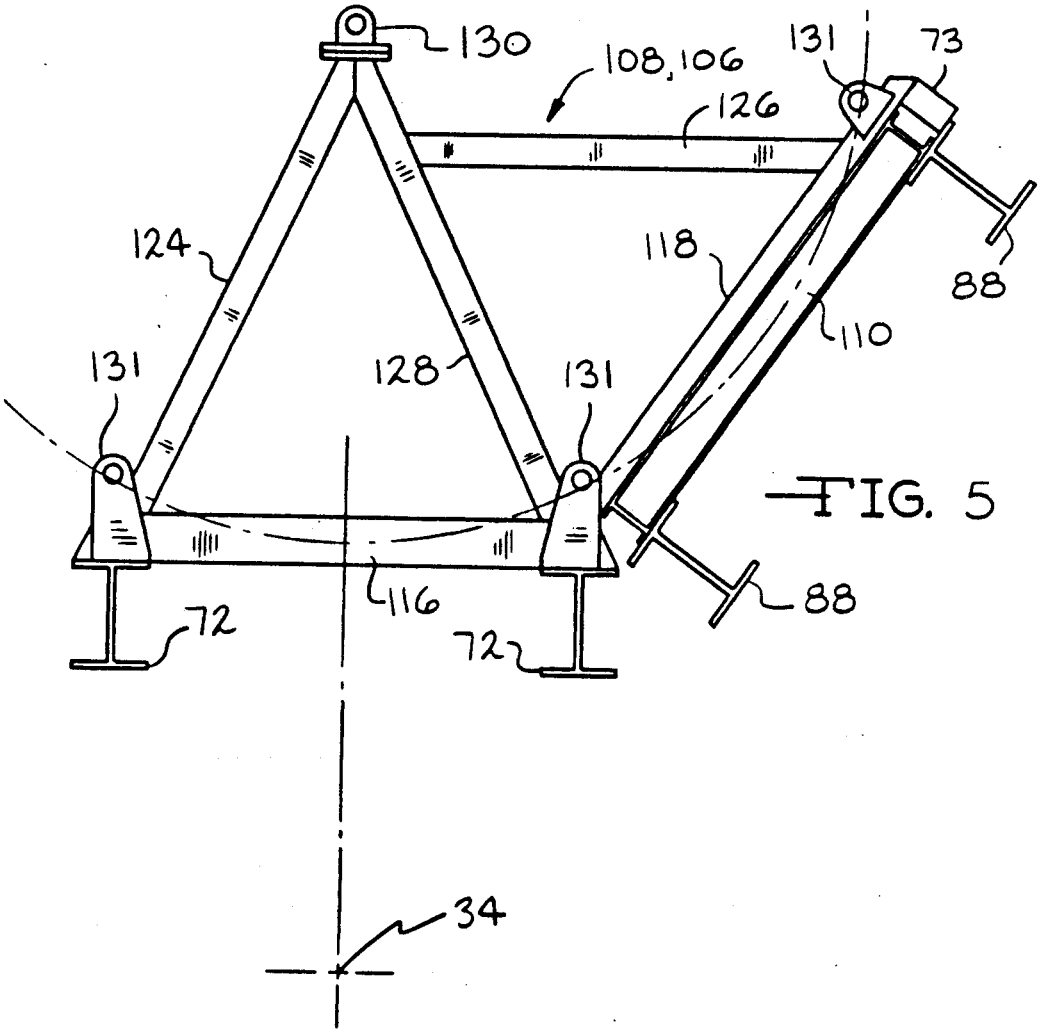
FIG. 5 is a plan view of the lower sections of the apparatus frame taken along line 5—5 in FIG. 3.

FIG. 5 is similar to FIG. 4 showing the plan view of lower sections 106 and 108, which are identical. Lower rails 72 are welded to base member 116 in each of sections 106 and 108. Skids 88 are welded to detachable means 110 which is bolted to a base member 118 in each of sections 106 and 108. The opposing ends of base members 116 and 118 are connected by members 124 and 126 respectively. The adjacent ends of base members 116 and 118 are connected to members 124, 126 by a member 128. Members 124, 126 and member 128 form rigid triangular structures for supporting rails 72 and skids 88. Each of sections 106, 108 is rotatably connected to horizontal braces 94, 96 respectively by a flange 130. The ends of base members 116 and 118 include lock pin holes 131 for receiving lock pins 133.

Figure 6:
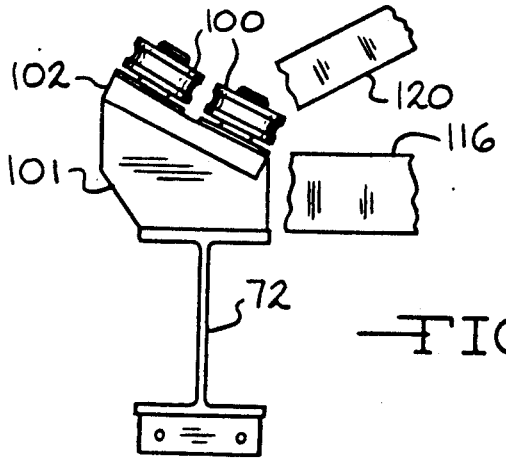
FIG. 6 is a detailed plan view of one pair of the track rollers in FIG. 4.

FIG. 6 is a plan view illustrating detail of one pair of track rollers 100 which support upper section 104 from curved track 78.

Figure 7:
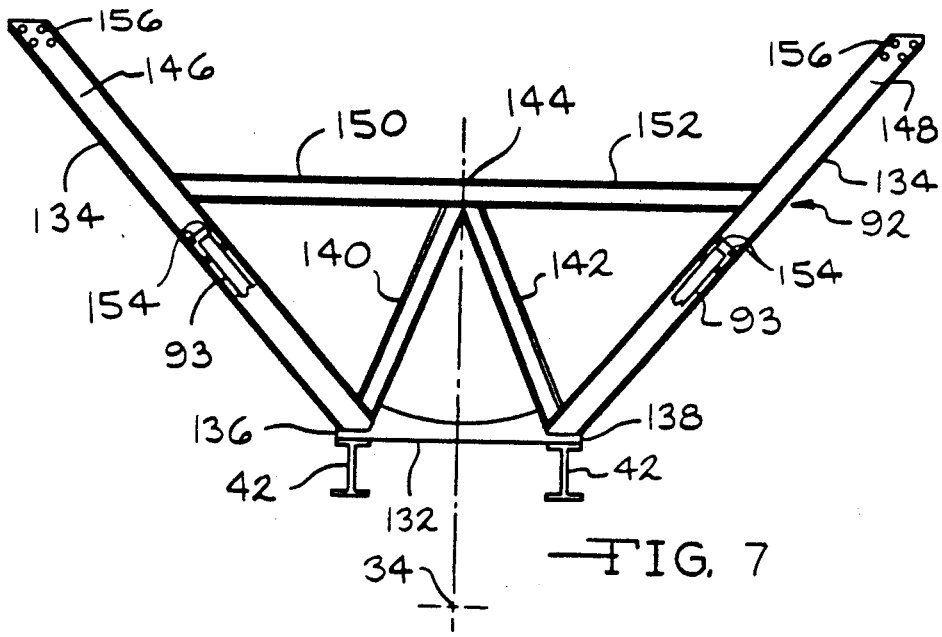
FIG. 7 is a plan view of the upper brace in FIG. 2.

FIG. 7 is a plan view illustrating upper horizontal brace 92. Brace 92 includes a cross tie member 132 and a pair of identical side base members 134. In addition to supporting upper section 104, brace 92 also supports hanger 80 by welding or bolting cross tie member 132 to the upper surface of hanger 80. Opposing ends 136, 138 of cross tie member 132 are welded to upper rails 42 and are connected by members 140, 142 respectively forming an apex 144. Apex 144 of members 140, 142 is connected to each of side base members 134 by members 150, 152. End portions 146, 148 of side base members 134 each includes bolt holes 156 for connecting horizontal brace 92 to derrick 16. Support beams 93 are connected to upper brace 92 by bolts 154.

Figure 8:
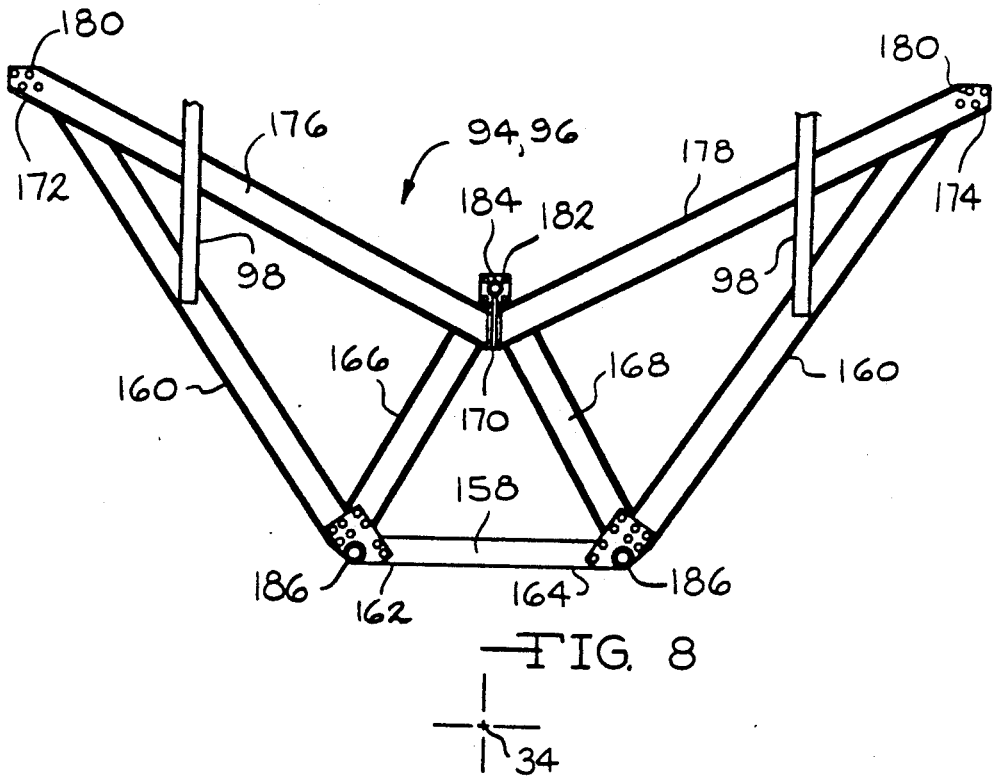
FIG. 8 is a plan view of the lower braces in FIG. 2.

FIG. 8 is a plan view illustrating horizontal braces 94 and 96, which are identical, and support sections 106, 108 respectively. Braces 94, 96 include a central base member 158 and a pair of identical side base members 160. Opposing ends 162, 164 of base member 158 are connected by members 166, 168 respectively forming an apex 170. Apex 170 of members 166, 168 is connected to side base members 160 by end portions 172, 174 of members 176 and 178 respectively. End portions 172, 174 include bolt holes 180 for connecting horizontal braces 94, 96 to derrick 16. Side base members 160 also are connected to derrick 16 by support beams 98. Each of braces 94, 96 includes a pivot flange 182 for supporting a trunnion shaft 184. Shaft 184 pivotally connects sections 106 and 108 by flanges 130 to derrick 16 via braces 94 and 96 respectively. Ends 162, 164 of base members 158 include lock pin holes 186. As will explained more fully later, frame 76 is secured to the braces by placing lock pins 133 through lock pin holes 131 in sections 106, 108 and lock pin holes 186 in braces 94, 96.

Figure 9:
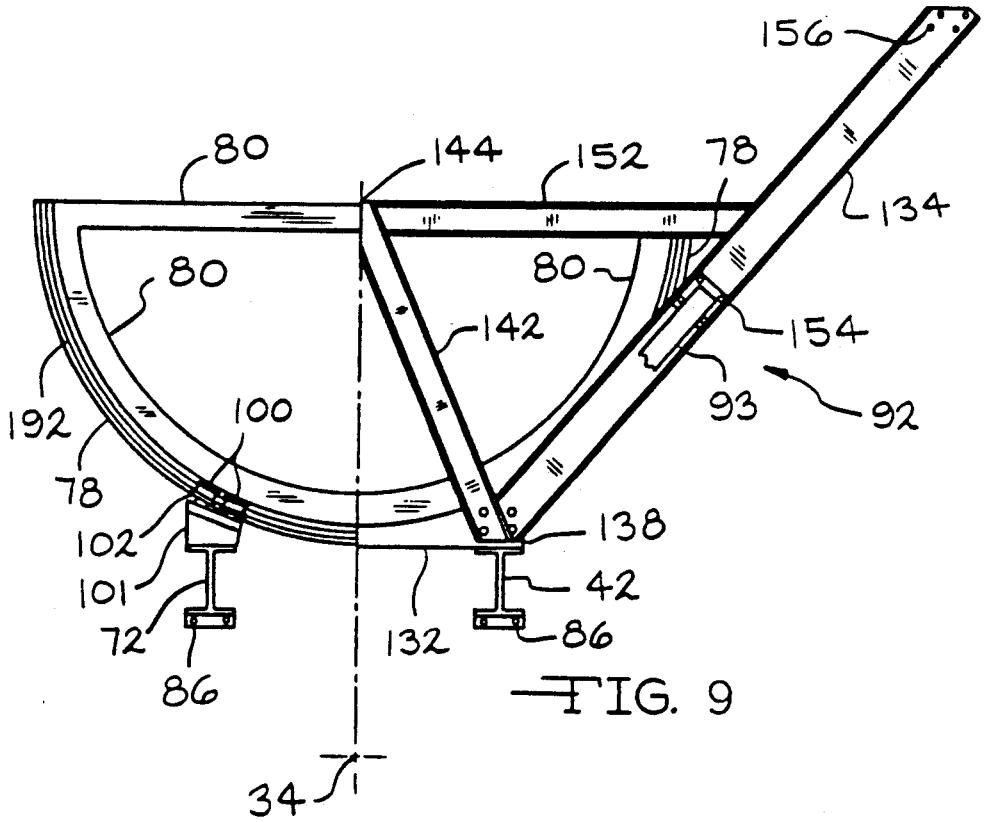
FIG. 9 is a plan view taken along line 9—9 in FIG. 2.

FIG. 9 is a plan view taken along line 9—9 in FIG. 2 illustrating curved track 78, hanger 80 and upper brace 92 with portions of brace 92 and upper section 104 removed. Hanger 80 connects curved track 78 to derrick 16 through side base members 134 in brace 92.

FIG. 10 is an enlarged side elevation view of rotating apparatus 70 during rotation relative to upper rails 42. A misalignment 190 between lower rails 72 and upper rails 42 illustrates apparatus 70 being rotated clockwise to align skids 88 with rails 42 or when apparatus 70 is being rotated counterclockwise rotating rails 72 back into realignment with rails 42. A round rod 192 is welded to the upper circumferential surface of curved track 78. Apparatus 70 is rotatably supported by track 78 by rollers 100 on rod 192. Rollers 100 are journaled to rails 72 by a trunnion 102 connected to a flange 101. The surface of each of rollers 100 is provided with a recess 194 for receiving rod 192.

Figure 11:
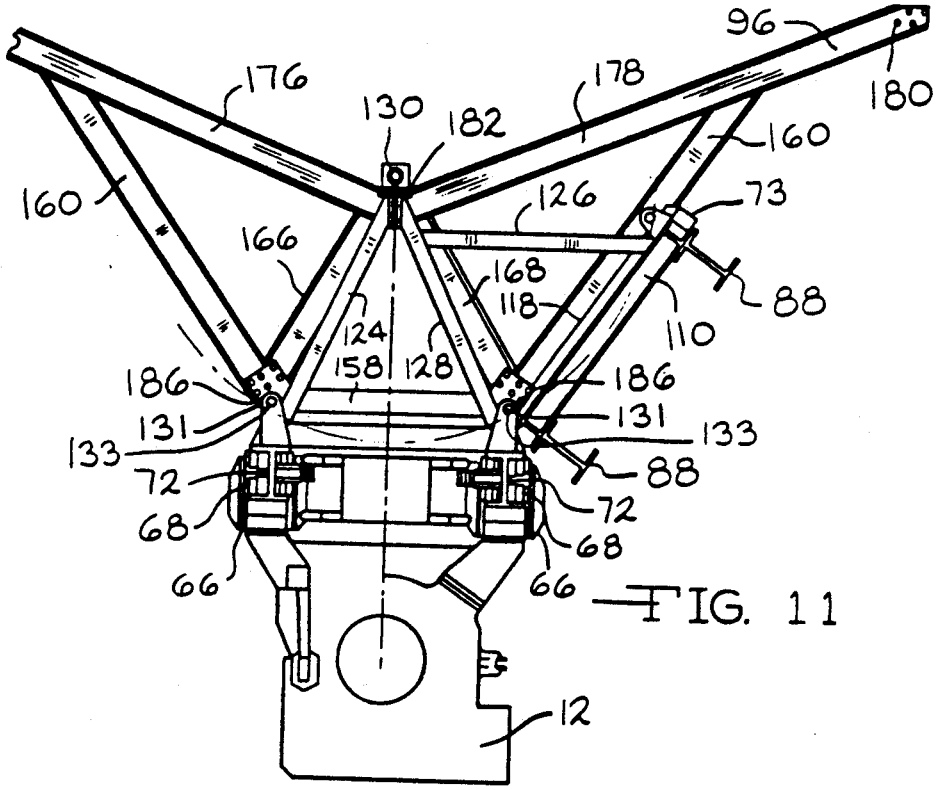
FIG. 11 is a plan view illustrating the suspended drilling unit with the lower pair of rails in the drilling position.
Figure 12:
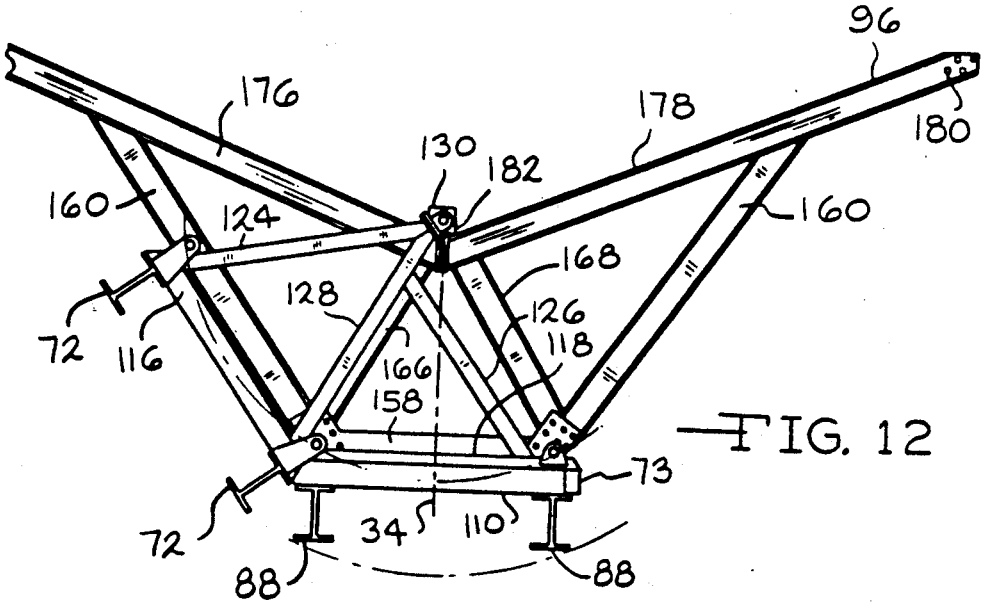
FIG. 12 is a plan view illustrating the suspended drilling unit in FIG. 11 elevated to a position above the lower pair of rails and the frame rotated clockwise with the skids aligned with the upper pair of rails.
Figure 17:
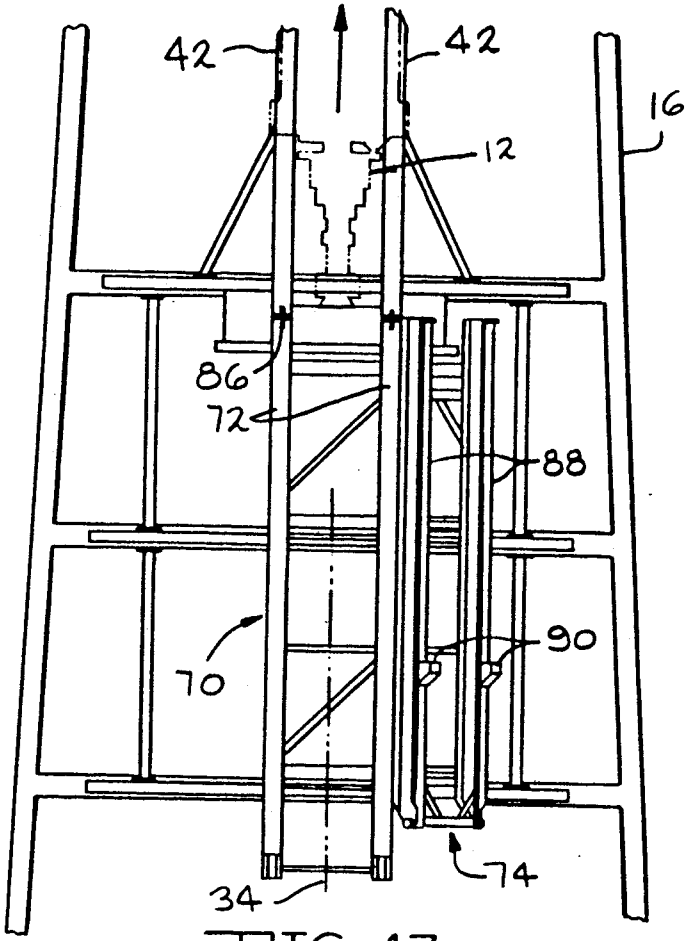
FIG. 17 is an elevation view similar to FIG. 11 with the suspended drilling unit elevated to a position above the lower pair of rails.
Figure 16:
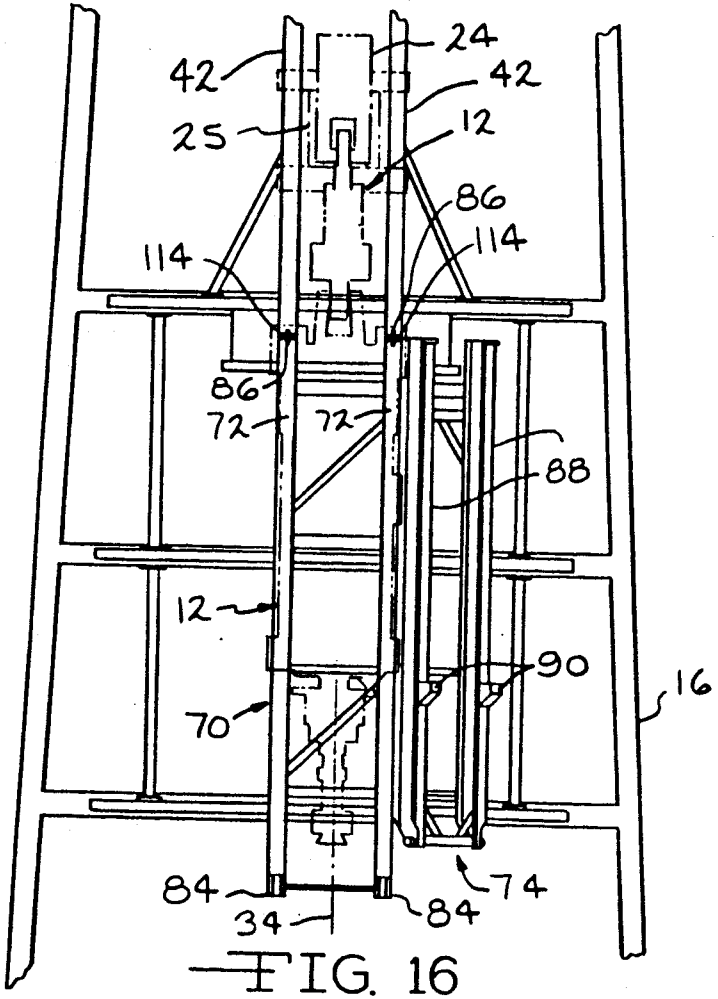
FIG. 16 is an elevation view of FIG. 11 illustrating the apparatus for laterally moving the drilling unit with the lower rails in the drilling position.
Figure 19:
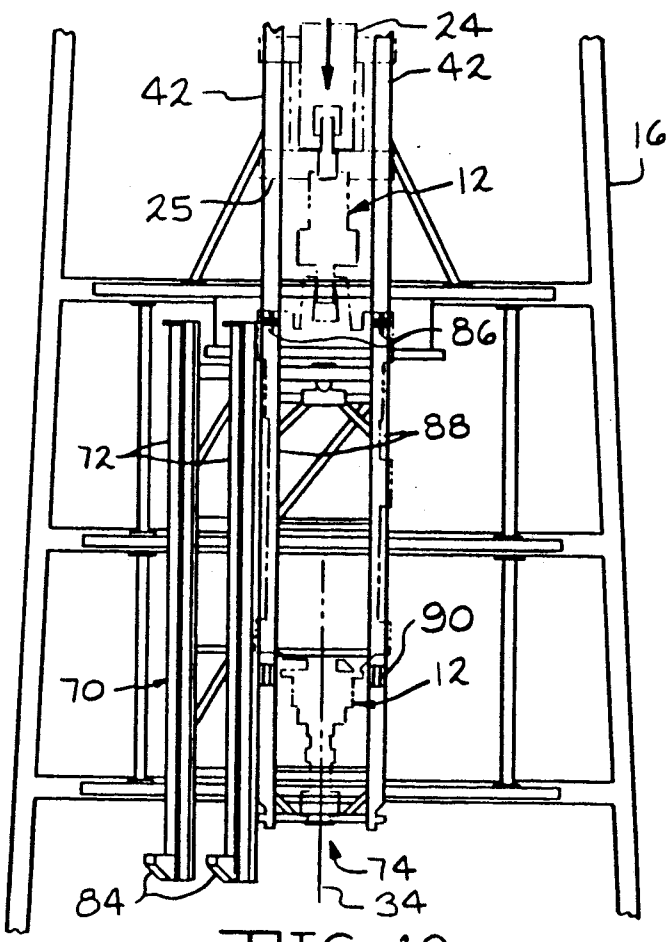
FIG. 19 is an elevation view of FIG. 14.
Figure 18:
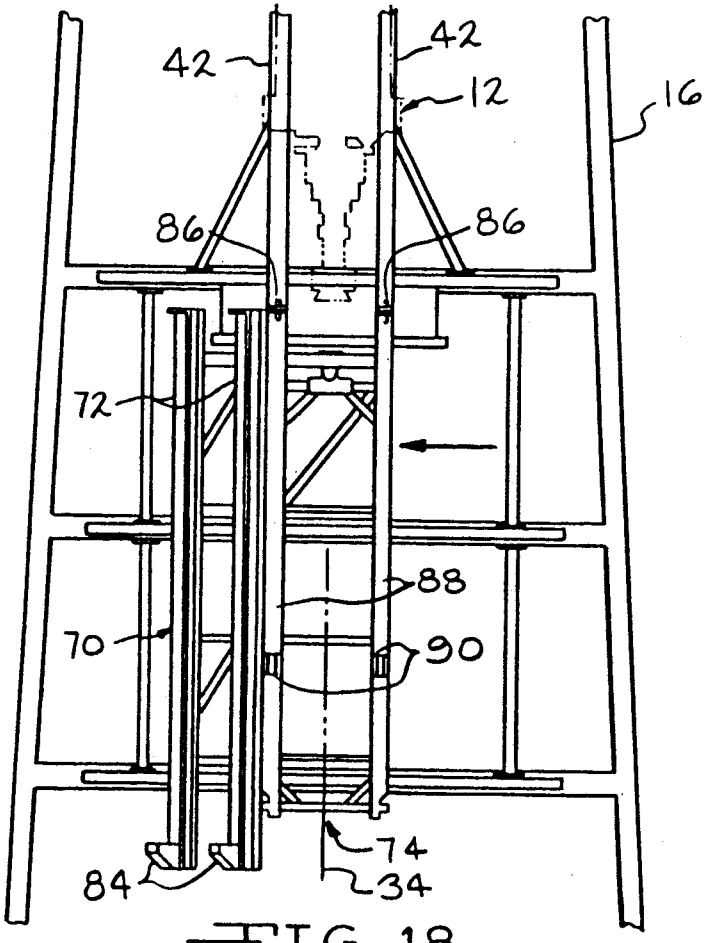
FIG. 18 is an elevation view of FIG. 12.
Figure 20:
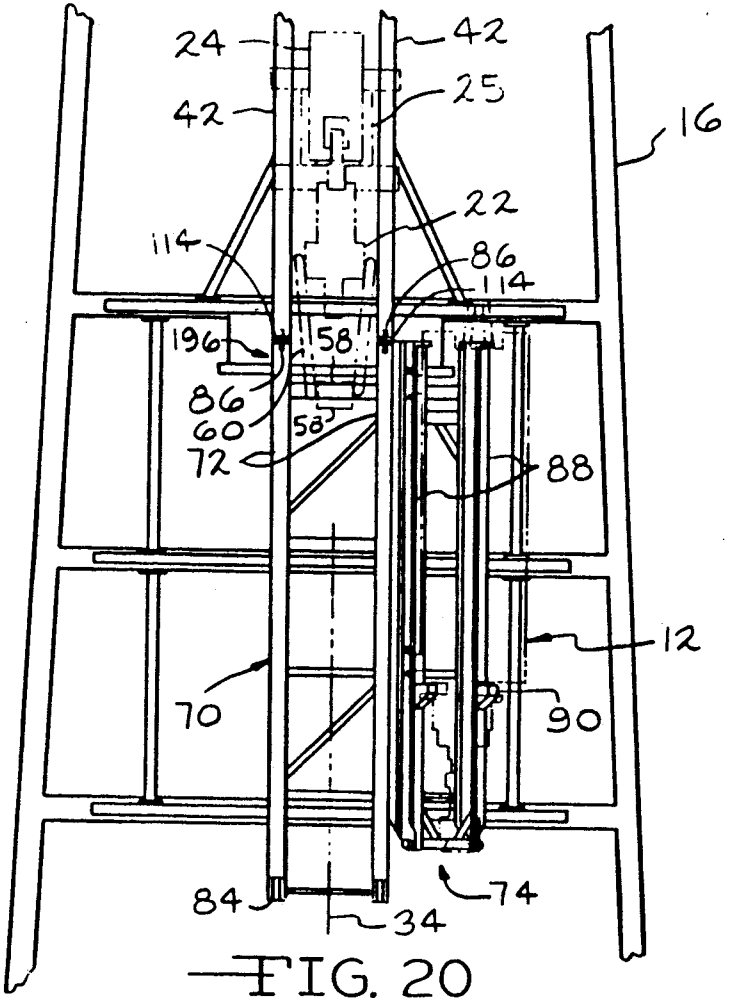
FIG. 20 is an elevation view of FIG. 15.

Operation of the well drilling equipment using the invention now will be described in particular reference to FIGS. 11-20. Well 34 is deepened by the cutting action of bit 36 during rotation of drill string 32 by drill motor 48. As well 34 is deepened, power swivel 12 simultaneously travels downwardly being guided by upper rails 42 and finally along lower rails 72 until a point just above derrick floor 26 is reached as illustrated in FIGS. 11 and 16. It now may be necessary to replace drill bit 36, perform maintenance on power swivel 12, replace power swivel 12, or otherwise temporarily remove power swivel 12 from the centerline of the well. Drawworks 20 is operated to elevate power swivel 12 until lowermost rollers 68 disengage lower rails 72, pass rail splice joint 86, and engage nonrotating upper rails 42 as illustrated in FIG. 17. Lock pins 114 are removed from splice joints 86 and lock pins 133 are removed from holes 131 in frame 76 and holes 186 in braces 94 and 96. Frame 76 of apparatus 70 now is free to be rotated clockwise relative to braces 92, 94, 96 to the position shown in FIGS. 12 and 18 wherein skids 88 are aligned with upper rails 42. Lock pins 114, 133 may be replaced to secure frame 76 and power swivel 12 now is lowered by drawworks 20 until the lowermost rollers 68 engage stops 90 on skids 88. This is the position illustrated in FIGS. 13, 14 and 19. Hook 22 now is disengaged from bail 62 on power swivel 12. Any splice pins or lock pins replaced to secure frame 76 are removed and frame 76 now is rotated counterclockwise until lower rails 72 are realigned with upper rails 42. Power swivel 12 has been horizontally displaced to the offset or inactive position illustrated in FIGS. 15 and 20. Since frame 76 rotates about shaft 184 located at a position inline with well axis 34 rather than from a position from one side of well axis 34, mud lines, power service lines, and the like, are twisted about 55° when power swivel 12 is laterally moved from the drilling position to the offset position. Lock pins 114, 133 are replaced, conventional hoisting equipment now may be attached to hook 22 and tripping completed. The present invention is especially advantageous for when traveling block 24 is mounted on guide carriage 25 such as illustrated in FIG. 13. On offshore well drilling platforms using a power swivel, the traveling block normally is guided by the rails using a guide carriage to prevent swinging of the traveling block within the derrick. By moving the power swivel to an offset position and having the lower pair of rails 72 aligned with the upper pair of rails 42, traveling block 24 supporting conventional pipe handling equipment 196 can be operated the full length of derrick 16 being guided by guide carriage 25 along pairs of rails 42 and 72. That is to say, pipe handling equipment 196 can be operated at its lowermost position at the bottom of the lower pair of rails 72 to a point near derrick floor 26 during a tripping sequence.

Figure 21:
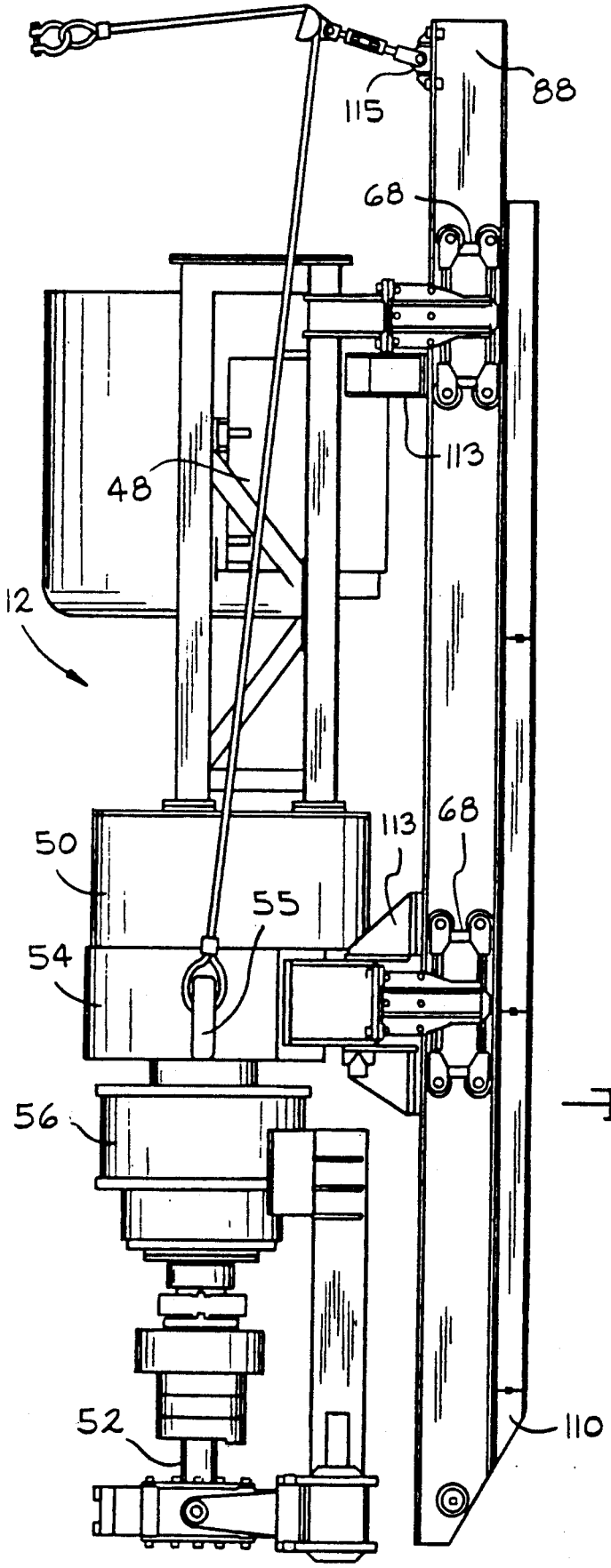
FIG. 21 is an elevation view illustrating the drilling unit having been removed from the derrick while attached to the support means.

It was previously indicated skids 88 are welded to detachable means or frame 110 which is bolted to base members 118. In some instances it is advantageous to be able to remove the power swivel from the derrick such as for repair or replacement. Because of its massive size, the power swivel would otherwise be difficult to handle when removing from the derrick. By being detachably connected to frame 76, support means 74 and power swivel 12 easily can be lifted from derrick 16 when skids 88 are in alignment with rails 42. As illustrated in FIG. 21, a cable can be placed through a lifting beam 115 and a lifting lug 55 on housing beam 54 and detachable frame 110 then removed from or installed in derrick 16 using drawworks 20 and hoisting equipment such as a crane. When it becomes necessary for power swivel 12 to be removed from or installed in derrick 16, power swivel 12 first is rigidly connected to skids 88 by installing shipping brackets. Shipping brackets 113 secure motor assembly 44 and pipe handling assembly 46 to skids 88 by bolting.

Figure 22:
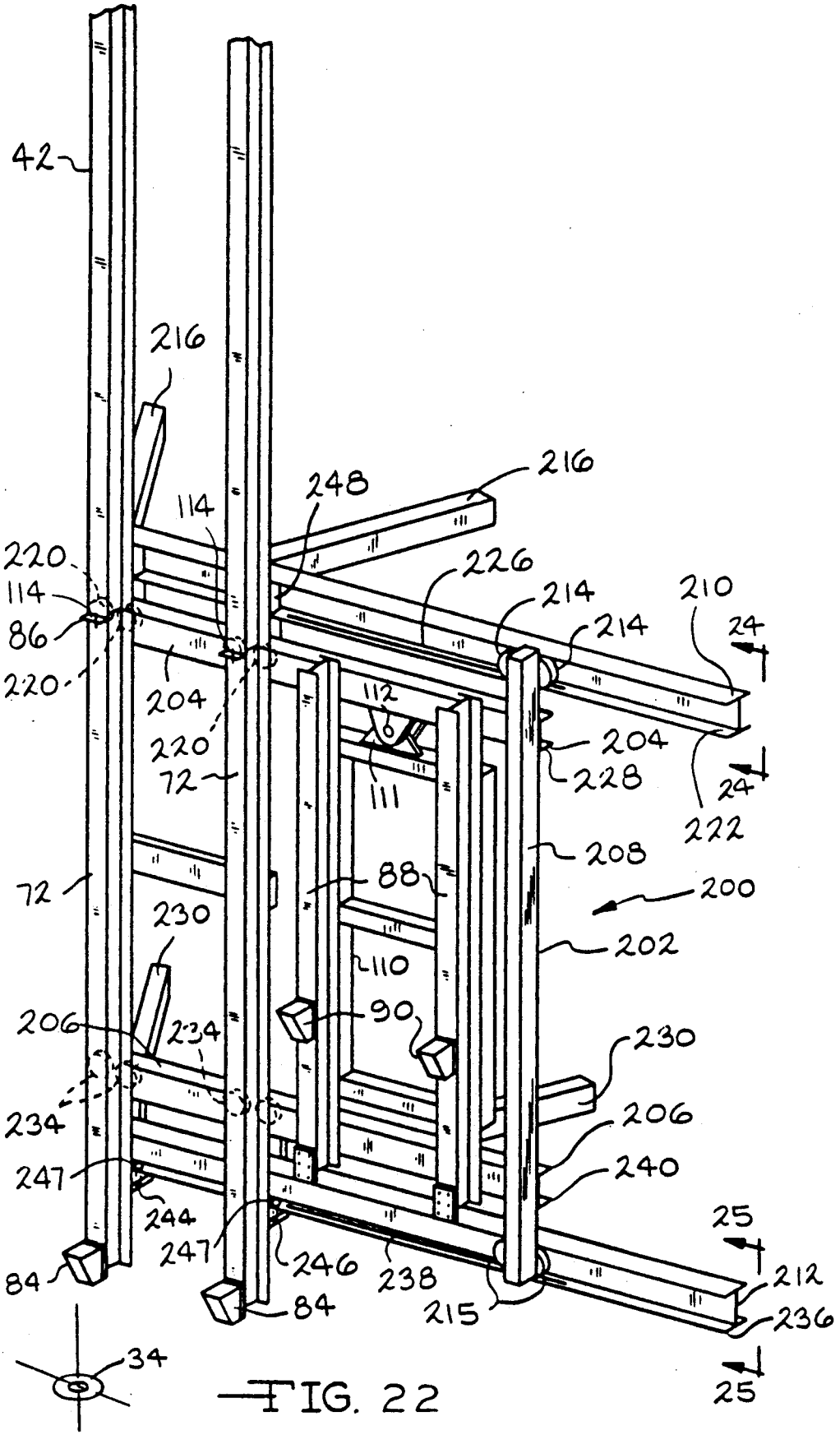
FIG. 22 is an isometric view of another embodiment of the apparatus for laterally moving the drilling unit to an offset position with the lower pair of rails in the drilling position.
Figure 23:
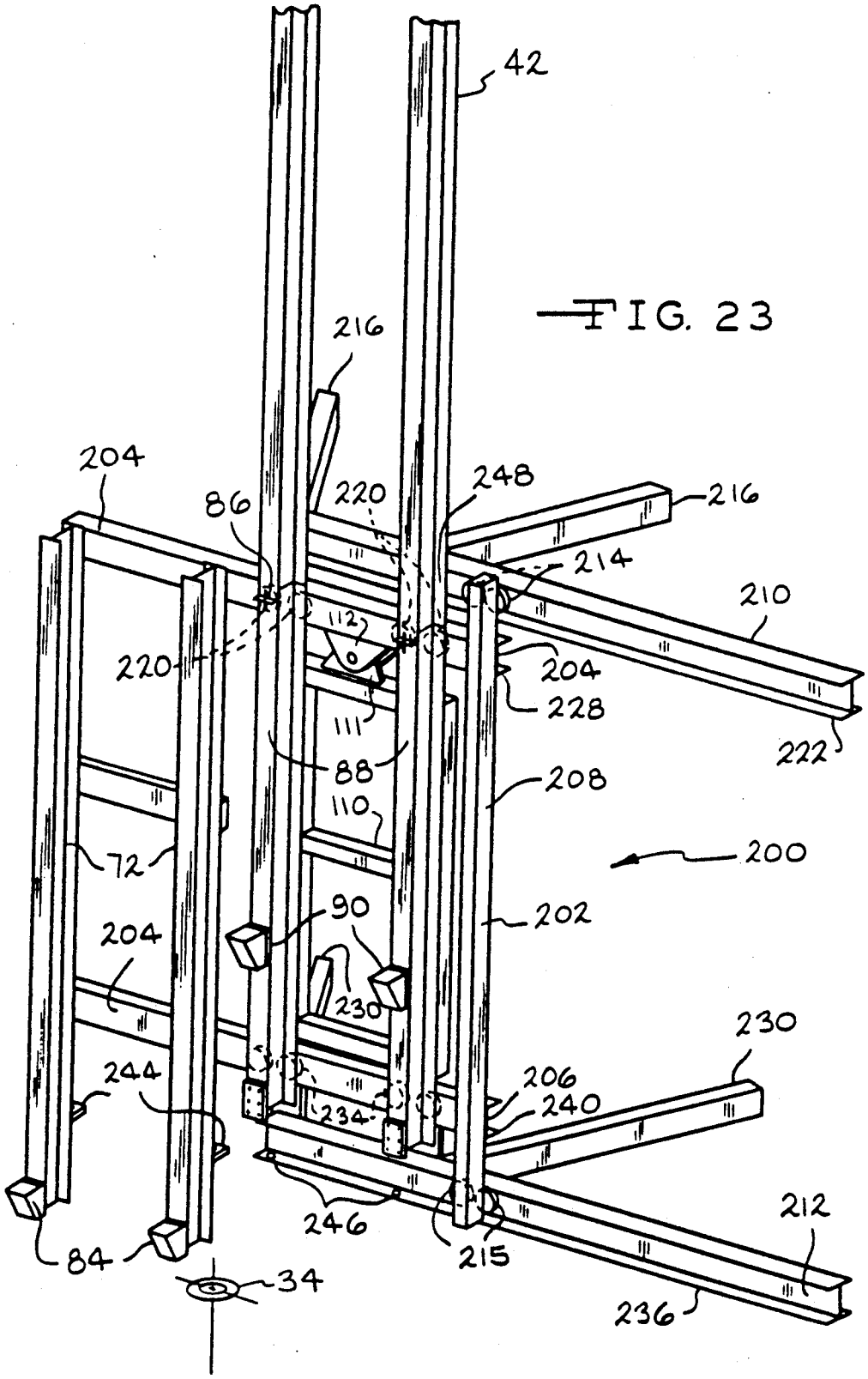
FIG. 23 is an isometric view of the embodiment of FIG. 22 with the skids aligned with the upper pair of rails.
Figure 26:
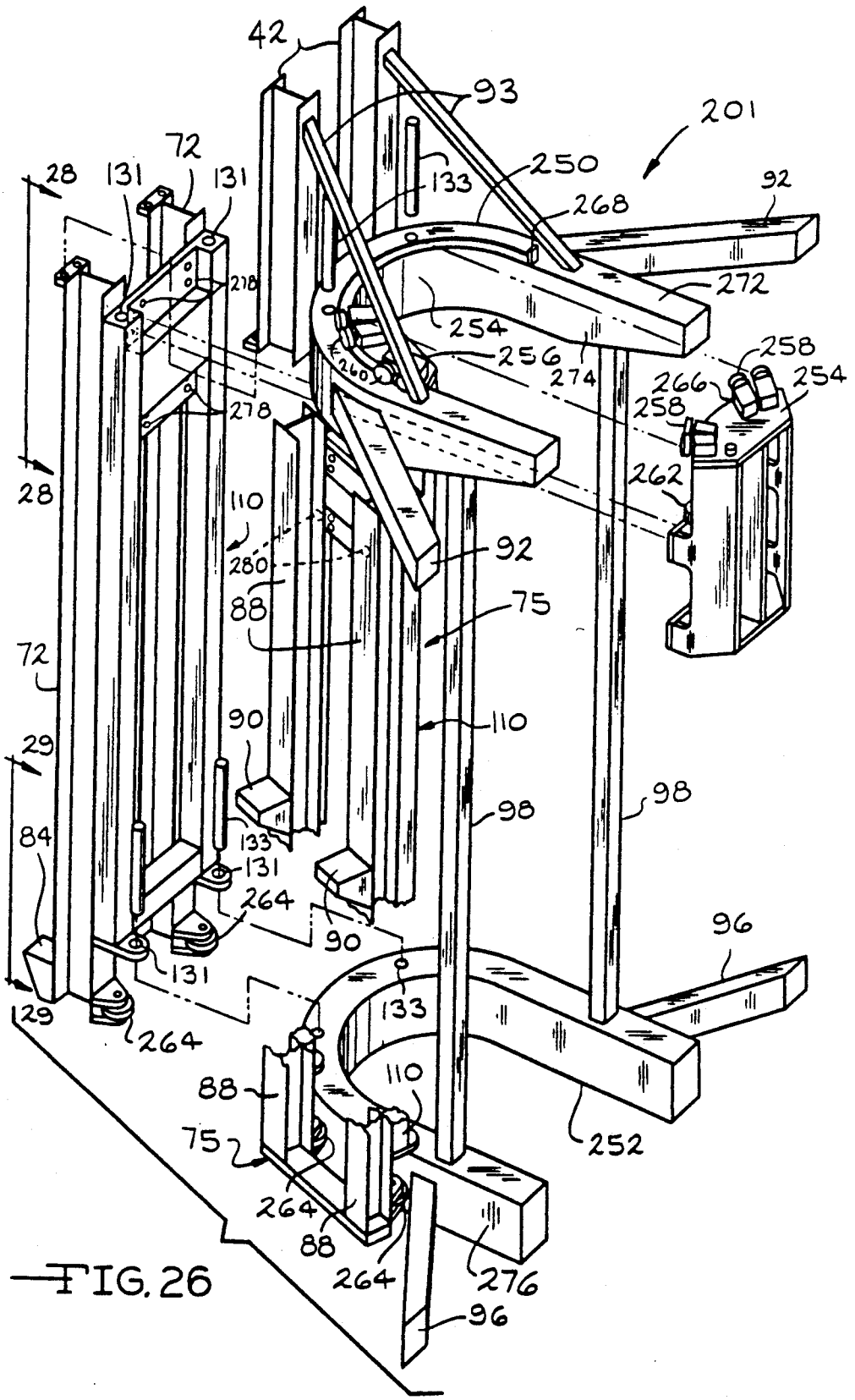
FIG. 26 is an isometric view of another embodiment of the apparatus for laterally moving the drilling unit to an offset position with the lower pair of rails in the drilling position.
Figure 27:
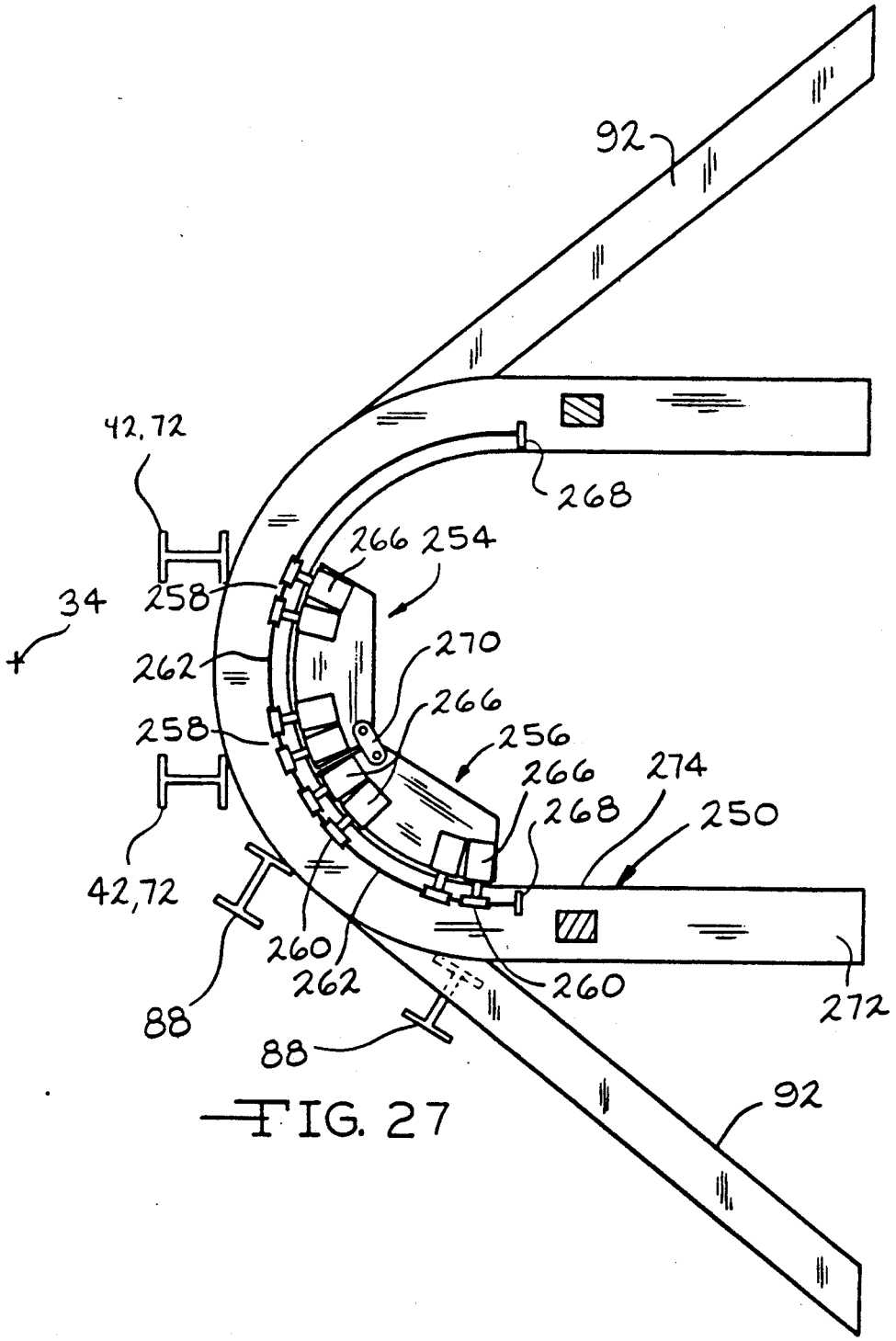
FIG. 27 is a plan view of the apparatus of FIG. 26.
Figure 28:
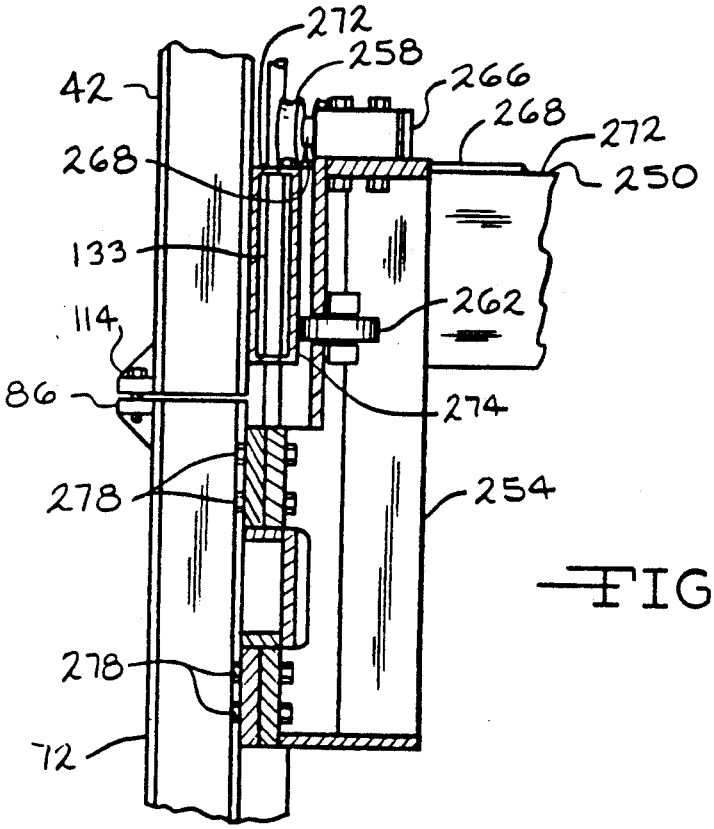
FIG. 28 is an elevation view taken along line 28—28 of FIG. 26.

Apparatus 70 described above for laterally moving power swivel 12 to an offset position preferably is rotatably connected to derrick 16. FIGS. 22 and 23 illustrate another embodiment for an apparatus 200 for laterally moving a power swivel to an offset position. In this embodiment, structural members identical to those previously described for apparatus 70 are given like numerals. Apparatus 200 includes lower rails 72 and skids 88 connected to a frame 202. Frame 202 includes an upper horizontal beam 204, a lower horizontal beam 206, and a vertical beam 208. Rails 72 and skids 88 are bolted or welded to beams 204, 206 which in turn are bolted to beam 208. A pair of rollers 214 is journaled to the upper end of beam 208 (FIG. 24) and supported by a lower flange 222 on an upper horizontal track 210. A pair of rollers 215 also is journaled to the lower end of beam 208 (FIG. 25) and supported by a lower flange 236 on a lower horizontal track 212. Horizontal tracks 210,212 would be connected to the derrick. Juxtaposed upper pairs of rollers 220 are journaled to flanges 218 on a pair of upper braces 216. One end of braces 216 is connected to track 210 at a position just behind rails 42 and the other end of braces 216 (not shown) would be connected to the derrick. Juxtaposed lower pairs of rollers 234 are journaled to flanges 232 on a pair of lower braces 230. One end of braces 230 is connected to track 212 at a position just behind rails 72 and the other end of braces 230 (not shown) would be connected to the derrick. As best seen in FIGS. 24 and 25, the surface of rollers 214 are provided with a recess 224 for receiving a round rod 226 welded to lower flange 222 on upper track 210. Lower rollers 215 are provided with a similar recess for receiving a round rod 238 welded to lower flange 236 on lower track 212. The surfaces of rollers 220, 234 have similar recesses for receiving a round rod 242 welded to upper flange 228 on upper beam 204 and to upper flange 240 on lower beam 206. FIG. 22 illustrates rod 226 extending from a stop surface 248 adjacent to the lower end of right hand upper rail 42 to a point along flange 222 on track 210 to the right of beam 208. Rod 238 extends in a similar manner along flange 236 on track 212.

FIG. 22 illustrates lower rails 72 being in the drilling position by being below and aligned with upper rails 42. When is desired to position the power swivel in the offset or inactive position, the drawworks would be operated to elevate the power swivel to a position above lower rails 72 along fixed upper rails 42. Lock pins 114 then would be removed from rail splices 86, lock pins 247 would be removed from holes 246 in flange 236 of lower track 212 and from the holes in flanges 244 welded to the back side of rails 72, and frame 202 slide from right to left relative to well axis 34 to the position illustrated in FIG. 23 until contacting stop surface 248. This coincides with skids 88 being aligned with upper rails 42. The power swivel now would be lowered until supported by stops 90. After disconnecting the power swivel from the traveling block, frame 202 now would be slide from left to right and returned to the position shown in FIG. 22 with the power swivel being in the offset position as previously described in FIGS. 15 and 20.

Figure 29:
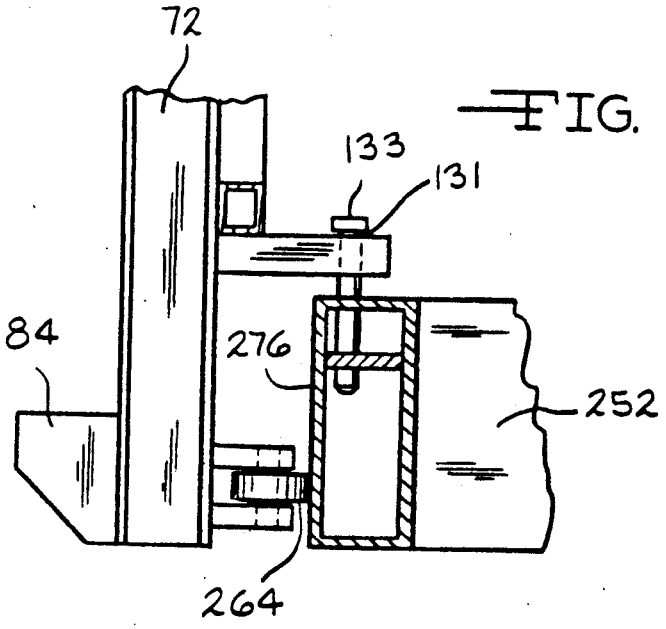
FIG. 29 is an elevation view taken along line 29—29 of FIG. 26.

FIGS. 26–29 illustrate a further embodiment for an apparatus 201 for laterally moving a power swivel to an offset position. In this embodiment, structural members identical to those previously described for apparatus 70 and apparatus 200 are given like numerals. Apparatus 201 includes lower rails 72 for positioning below and in alignment with upper rails 42 and means 75 for supporting power swivel 12 in an inactive or offset position. Rails 72 and support means 75 each are rigidly connected by bolting or welding to separate frames 110. The upper end of each frame 110 is detachably connected to a support carriage which is supported by an upper curved track 250 connected to derrick 16 by brace 92 and the lower end of each frame 110 is supported by a lower curved track 252 connected to derrick 16 by brace 96. Frame 110 for lower rails 72 is detachably connected to a support carriage 254 by bolts 278 and frame 110 for skids 88 is detachably connected to a support carriage 256 by bolts 280. Support carriages 254 and 256 are supported on upper track 250 by pairs of rollers 258 and 260 respectively journaled in trunnions 266. Rollers 258 and 260 of carriages 254 and 256 are maintained in continuous engagement with the upper surface 272 of track 250 by an upstanding flange 268 provided around the upper inner surface 274 of track 250. Additional support for carriages 254 and 256 is provided by lower rollers 262 which engage inner surface 274 of track 250. Support carriages 254 and 256 are connected together by a link 270 (FIG. 27) for simultaneous rotation of the carriages along track 250. If it is desired to rotate only one of the support carriages or to rotate them separately, link 270 can be removed. A pair of rollers 264 is journaled to the bottom portion of each frame 110 for supporting each frame 110 during rotation of apparatus 201. Rollers 264 engage the outer surface 276 of lower curved track 252 as illustrated in FIG. 29. Unlike that for apparatus 70 and apparatus 200 described above, lower rails 72 or skids 88 of apparatus 201 and any hoisting, pipe handling, or drilling equipment supported thereby can be removed from derrick 16 by by removing bolts 278,280 from carriages 254,256 respectively.

It will be understood various modifications may be made to the invention without departing from the spirit and scope of it. For example, various cross sectional configurations and numbers of the structural members described herein can be used. The apparatus for moving the power swivel to an offset position can be rotatable, slidable, or otherwise connected to the derrick. The apparatus for moving the power swivel can be manually or power actuated. Means for supporting the power swivel may include a rolling frame supported on a curved or a straight track. Therefore, the limits of the invention should be determined from the appended claims.

I claim:

1. For use with a derrick, well drilling equipment comprising:

means for suspending equipment for generally vertical travel within the derrick, a power swivel suspendable from said suspension means, said power swivel including a drill motor for rotating a drill string in a well, means for guiding said power swivel during said travel, said guide means including a first pair of rails connected to the derrick and extending parallel to the axis of the well, and apparatus connected to the derrick for moving said power swivel laterally relative to the axis of the well to an offset position, said apparatus including a second pair of rails and means for supporting said power swivel, said second pair of rails being positioned below and in alignment with said first rails when said support means is in said offset position whereby said suspension means can travel the full length of said first and second pair of rails when said support means is in said offset position.

2. The well drilling equipment of claim 1 wherein said support means includes a pair of skids.

3. The well drilling equipment of claim 1 wherein said apparatus is rotatably connected to the derrick.

4. The well drilling equipment of claim 1 wherein said apparatus includes a frame rotatably connected to the derrick, said second pair of rails being connected to said frame.

5. The well drilling equipment of claim 1 wherein said apparatus includes a frame rotatably connected to the derrick, said second pair of rails being connected to said frame, said support means being detachably connected to said frame.

6. The well drilling equipment of claim 1 wherein said apparatus includes a track connected to the derrick, and a frame supported by said track, said second pair of rails being connected to said frame.

7. The well drilling equipment of claim 6 wherein said track is straight.

8. The well drilling equipment of claim 5 wherein said apparatus includes a curved track connected to the derrick, said frame supported by said curved track.

9. The well drilling equipment of claim 6 wherein said frame includes a plurality of sections, said support means includes a pair of skids, each of said sections including first and second base members, said second pair of rails being connected to said first base members and said skids being connected to said second base members.

10. The well drilling equipment of claim 9 wherein said support means is detachably connected to said second base members.

11. The well drilling equipment of claim 6 wherein said frame includes a plurality of rollers, said frame supported by said rollers from said track.

12. The well drilling equipment of claim 1 wherein said guide means includes a guide carriage and said suspension means includes a traveling block, said traveling block being mounted on said guide carriage.

13. The well drilling equipment of claim 1 wherein said apparatus includes a track connected to the derrick and said support means includes a frame and a support carriage, said frame being detachably connected to said support carriage and said support carriage supported by said track.

14. The well drilling equipment of claim 2 wherein said apparatus includes a first support carriage, an upper track and a lower track, each of said tracks being connected to the derrick, the upper portion of said second pair of rails being connected to said first support carriage, said support means including a frame and a second support carriage, said skids being connected to said frame and the upper portion of said frame detachably connected to said second support carriage, said first support carriage being connected to said second support carriage, said support carriages being supported by said upper track and the lower portions of said second pair of rails and said frame being supported by said lower track.

15. For use with a derrick, well drilling equipment comprising:

a traveling block suspended for generally vertical travel within the derrick, a power swivel suspendable from said block, said power swivel including a drill motor for rotating a drill string in a well and a drive sleeve for threadably connecting the drill motor to the upper end of the drill string, means for guiding said power swivel during said travel, said guide means including a first pair of rails connected to the derrick and extending parallel to the axis of the well, and apparatus rotatably supported by the derrick for moving said power swivel laterally relative to the axis of the well to an offset position, said apparatus including a second pair of rails and a pair of skids for supporting said power swivel, said second pair of rails being positioned below and in alignment with said first pair of rails when said skids are in said offset position whereby pipe handling or drilling equipment suspended from said block can travel the full length of said first and second pairs of rails when said skids are in said offset position.

16. The well drilling equipment of claim 15 wherein said apparatus includes a track and a frame, said track being connected to the derrick, said frame including a plurality of rollers supported by said track, said second pair of rails and said skids being connected to said frame.

17. The well drilling equipment of claim 16 wherein said support means is detachably connected to said frame.

18. The well drilling equipment of claim 15 wherein said apparatus includes a track connected to the derrick, said support means including a frame detachably connected to a support carriage, said support carriage supported by said track.

19. For use with a derrick, well drilling equipment comprising:

a travelling block suspended for generally vertical travel within the derrick, a power swivel suspendable from said block, said power swivel including a drill motor for rotating a drill string in a well and a drive sleeve for threadably connecting the drill motor to the upper end of the drill string, means for guiding said power swivel during said travel, said guide means including a first pair of rails connected to the derrick and extending parallel to the axis of the well, and apparatus connected to the derrick for moving said power swivel laterally relative to the axis of the well to an offset position, said apparatus including a second pair of rails, a frame, a track and means for supporting said power swivel, said frame including a plurality of rollers for supporting said frame from said track, said second pair of rails being connected to said frame, said support means being detachably connected to said frame and including a pair of skids, said second pair of rails being positioned below and in alignment with said first pair of rails when said skids are in said offset position whereby pipe handling equipment suspended from said block can travel the full length of said first and second pairs of rails when said skids are in said offset position.

20. The well drilling equipment of claim 19 wherein said frame is rotatably connected to the derrick and said track is curved.

21. For use with a derrick, well drilling equipment comprising:

a travelling block suspended for generally vertical travel within the derrick, a power swivel suspendable from said traveling block, said power swivel including a drill motor for rotating a drill string in a well, first means for guiding said traveling block during said travel, second means for guiding said power swivel during said travel, said first and second guide means including a first pair of rails connected to the derrick extending parallel to the axis of the well, and apparatus connected to the derrick for moving said power swivel laterally relative to the axis of the well to an offset position, said apparatus including a second pair of rails and means for supporting said power swivel, said second pair of rails being positioned below and in alignment with said first pair of rails when said support means is in said offset position whereby whereby pipe handling or drilling equipment equipment suspended from said traveling block can travel the full length of said first and second pairs of rails when said support means is in said offset position.

22. The well drilling equipment of claim 21 wherein said first guide means includes a guide carriage.

23. The well drilling equipment of claim 21 wherein said apparatus includes a track and said support means includes a support carriage, said support carriage supported by said track.

24. A method of operating equipment suspended for generally vertical travel within a derrick during drilling of a well, the equipment including a power swivel, means for suspending the power swivel, and a first pair of rails connected to the derrick extending parallel to the axis of the well for guiding the power swivel, comprising the steps of:

providing a second pair of rails positionable below and in alignment with the first pair of rails, providing means for supporting the power swivel, elevating the power swivel by the suspension means to an elevation above said second pair of rails, laterally moving said support means to a position below and in alignment with the first pair of rails while moving said second pair of rails out of alignment therewith, lowering the power swivel onto said support means.

25. The method of claim 24 including the additional steps of:

disconnecting the power swivel from the suspension means, and moving said second pair of rails into alignment with the first pair of rails while moving the power swivel and said support means out of alignment therewith.

26. The method of claim 25 including the additional step of operating pipe handling equipment or drilling equipment suspended from the suspension means while the power swivel is in said offset position.

27. The method of claim 25 wherein said support means is detachably connected to the derrick, including the additional steps of:

disconnecting said support means from the derrick, removing said support means and the power swivel from the derrick, and operating pipe handling or drilling equipment suspended from the suspension means.

28. The method of claim 25 including the additional step of drilling the well using conventional rotary drilling equipment while the power swivel is in an offset position.

29. A method of operating equipment suspended for generally vertical travel within a derrick during drilling of a well, the equipment including a traveling block, a power swivel suspendable from the traveling block, a first pair of rails connected to the derrick extending parallel to the axis of the well for guiding the power swivel, comprising the steps of:

providing a second pair of rails positionable below and in alignment with the first pair of rails, providing means for supporting the power swivel, elevating the power swivel by the traveling block to an elevation above said second pair of rails, laterally moving said support means to a position below and in alignment with the first pair of rails while moving said second pair of rails out of alignment therewith, lowering the power swivel onto said support means, disconnecting the power swivel from the traveling block, and moving the second pair of rails into alignment with the first pair of rails while moving the power swivel and said support means out of alignment therewith whereby the traveling block can travel the full length of the first and said second pair of rails.

* * * * *